US010569568B2

(12) United States Patent
Tanizaki

(10) Patent No.: US 10,569,568 B2
(45) Date of Patent: Feb. 25, 2020

(54) PRINTER AND TAPE CARTRIDGE

(71) Applicant: Brother Kogyo Kabushiki Kaisha, Nagoya-shi, Aichi-ken (JP)

(72) Inventor: Masashi Tanizaki, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/844,075

(22) Filed: Dec. 15, 2017

(65) Prior Publication Data

US 2018/0104965 A1 Apr. 19, 2018

Related U.S. Application Data

(62) Division of application No. 15/216,021, filed on Jul. 21, 2016, now Pat. No. 9,855,768.

(30) Foreign Application Priority Data

Jul. 24, 2015 (JP) ..... 2015-146725

(51) Int. Cl.
*B41J 3/407* (2006.01)
*B41J 11/00* (2006.01)

(52) U.S. Cl.
CPC ..... *B41J 3/4075* (2013.01); *B41J 11/009* (2013.01)

(58) Field of Classification Search
CPC ..... B41J 3/4075; B41J 11/009; B41J 13/00; B41J 13/0009; B41J 15/00; B41J 15/04; B41J 15/044; B41J 15/046
See application file for complete search history.

(56) References Cited

U.S. PATENT DOCUMENTS

| | | | |
|---|---|---|---|
| 6,373,510 | B1 | 4/2002 | Hosokawa et al. |
| 7,121,751 | B2 | 10/2006 | Harada et al. |
| 2006/0013634 | A1 | 1/2006 | Harada et al. |
| 2007/0009306 | A1 | 1/2007 | Harada et al. |
| 2007/0041772 | A1 | 2/2007 | Harada et al. |
| 2010/0166475 | A1 | 7/2010 | Yamaguchi et al. |

(Continued)

FOREIGN PATENT DOCUMENTS

| | | | |
|---|---|---|---|
| CN | 101142087 | A | 3/2008 |
| CN | 102259506 | A | 11/2011 |

(Continued)

OTHER PUBLICATIONS

Jun. 5, 2018—(JP) Notice of Reasons for Refusal—App 2015-146725, Eng Tran.
Mar. 28, 2019—(CN) Office Action App. 201610561725.7.

*Primary Examiner* — Kristal Feggins
(74) *Attorney, Agent, or Firm* — Banner & Witcoff, Ltd.

(57) ABSTRACT

The disclosure discloses a printer including a cartridge holder, a feeder, a printing head, a first sensor, and a second sensor. The cartridge holder is configured to attach and detach a medium cartridge having a print-receiving medium. The first sensor is configured to bring a detector into contact with the medium cartridge and thereby detect first information related to the print-receiving medium, based on a result of the contact. The second sensor is configured to project light to the medium cartridge and thereby detect second information related to the print-receiving medium, based on a result of light reception corresponding to the projected light. The first sensor and the second sensor are integrated as a sensor unit configured to perform an advancing/retreating motion toward/from the medium cartridge.

20 Claims, 17 Drawing Sheets

(56) References Cited

U.S. PATENT DOCUMENTS

| | | | |
|---|---|---|---|
| 2010/0166477 | A1 | 7/2010 | Yamaguchi et al. |
| 2010/0166478 | A1 | 7/2010 | Yamaguchi et al. |
| 2010/0166479 | A1 | 7/2010 | Yamaguchi et al. |
| 2010/0166480 | A1 | 7/2010 | Yamaguchi et al. |
| 2010/0247205 | A1 | 9/2010 | Yamaguchi et al. |
| 2010/0247206 | A1 | 9/2010 | Yamaguchi et al. |
| 2010/0254742 | A1 | 10/2010 | Yamaguchi et al. |
| 2012/0080550 | A1 | 4/2012 | Yamaguchi et al. |
| 2015/0022614 | A1 | 1/2015 | Guan et al. |
| 2015/0273865 | A1 | 10/2015 | Kubota |

FOREIGN PATENT DOCUMENTS

| | | | |
|---|---|---|---|
| EP | 2977217 | A1 | 1/2016 |
| JP | H07-214826 | A | 8/1995 |
| JP | 2004-25563 | A | 1/2004 |
| JP | 2004-042468 | A | 2/2004 |
| JP | 2004114550 | A | 4/2004 |
| JP | 2010-167754 | A | 8/2010 |
| JP | 2010-167755 | A | 8/2010 |
| JP | 2011-251435 | A | 12/2011 |
| JP | 2012-116084 | A | 6/2012 |
| JP | 2012-116085 | A | 6/2012 |
| JP | 2012-201071 | A | 10/2012 |
| JP | 2013-95048 | A | 5/2013 |
| JP | 2014-184561 | A | 10/2014 |
| JP | 2015-063045 | A | 4/2015 |
| WO | 2014/173998 | A1 | 10/2014 |

[FIG. 1]
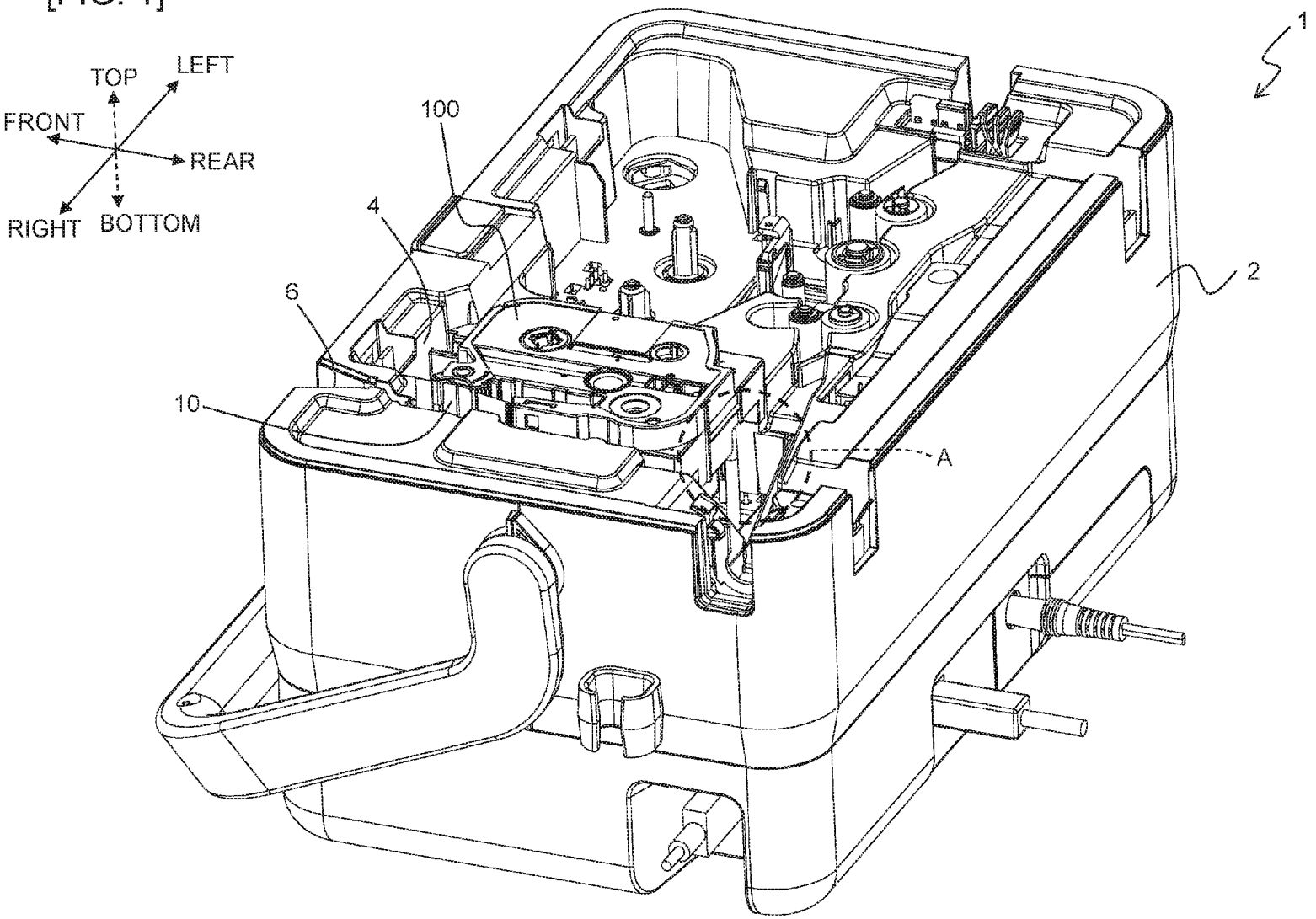

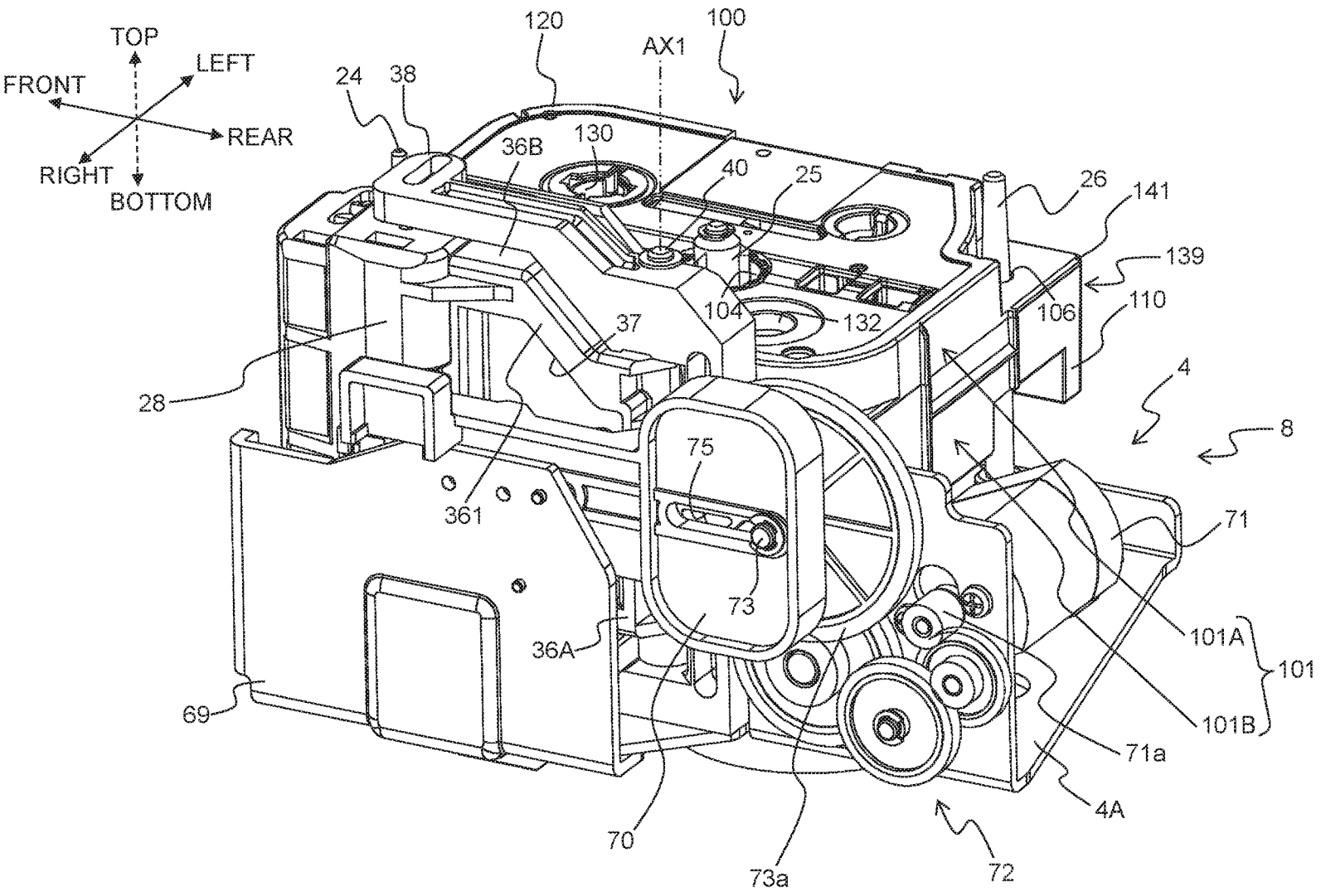
[FIG. 2]

[FIG. 3]
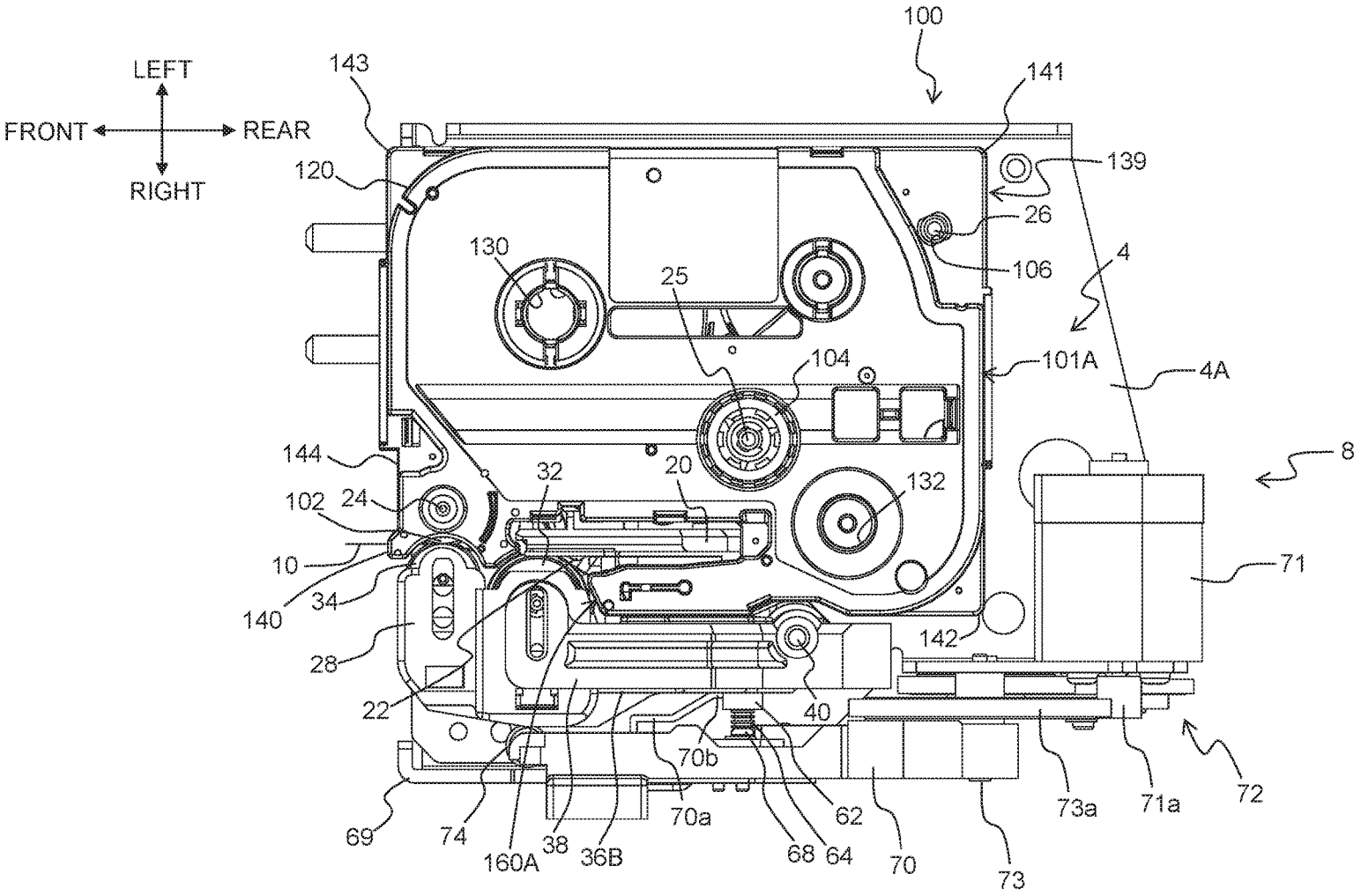

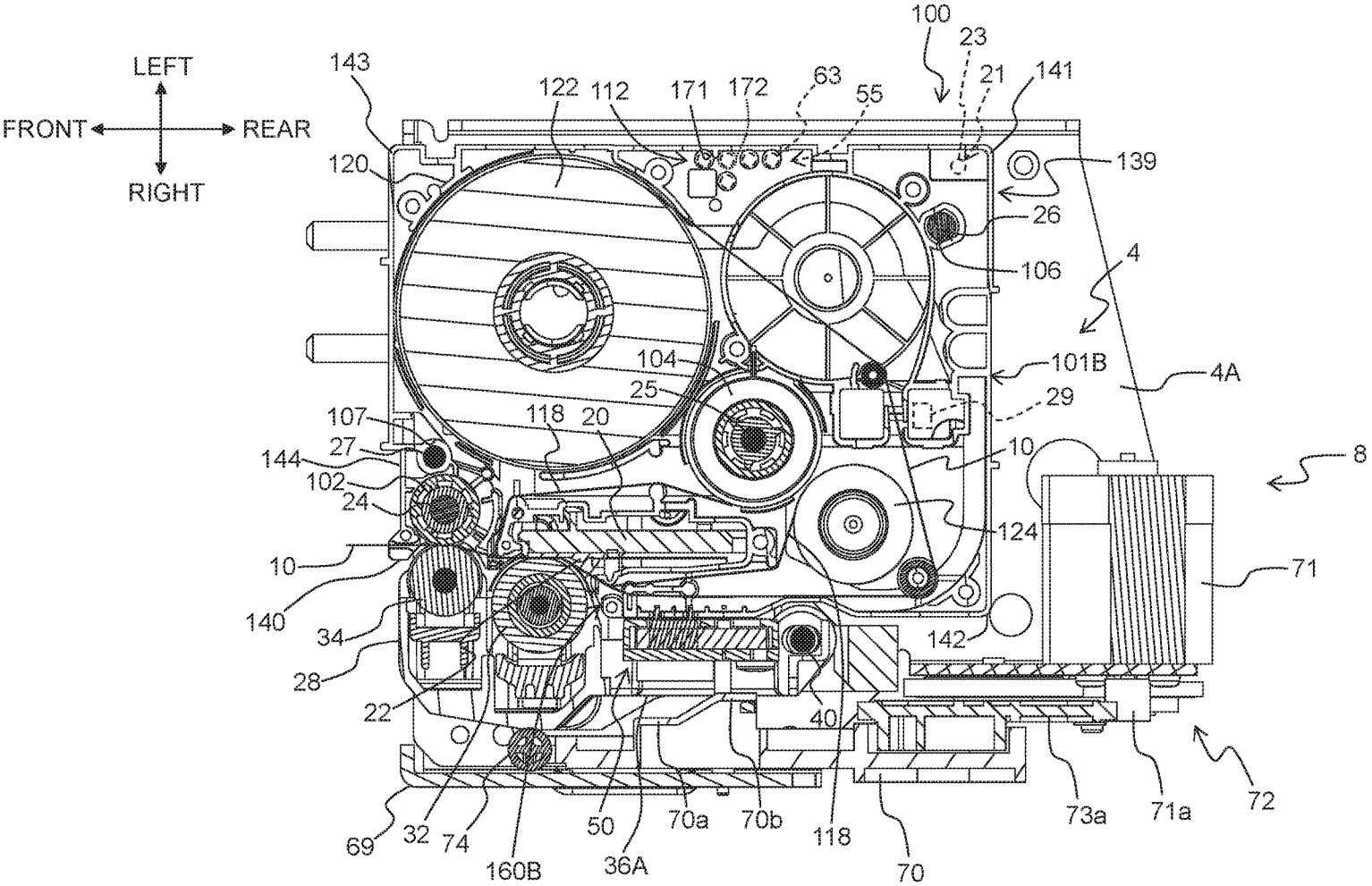
[FIG. 4]

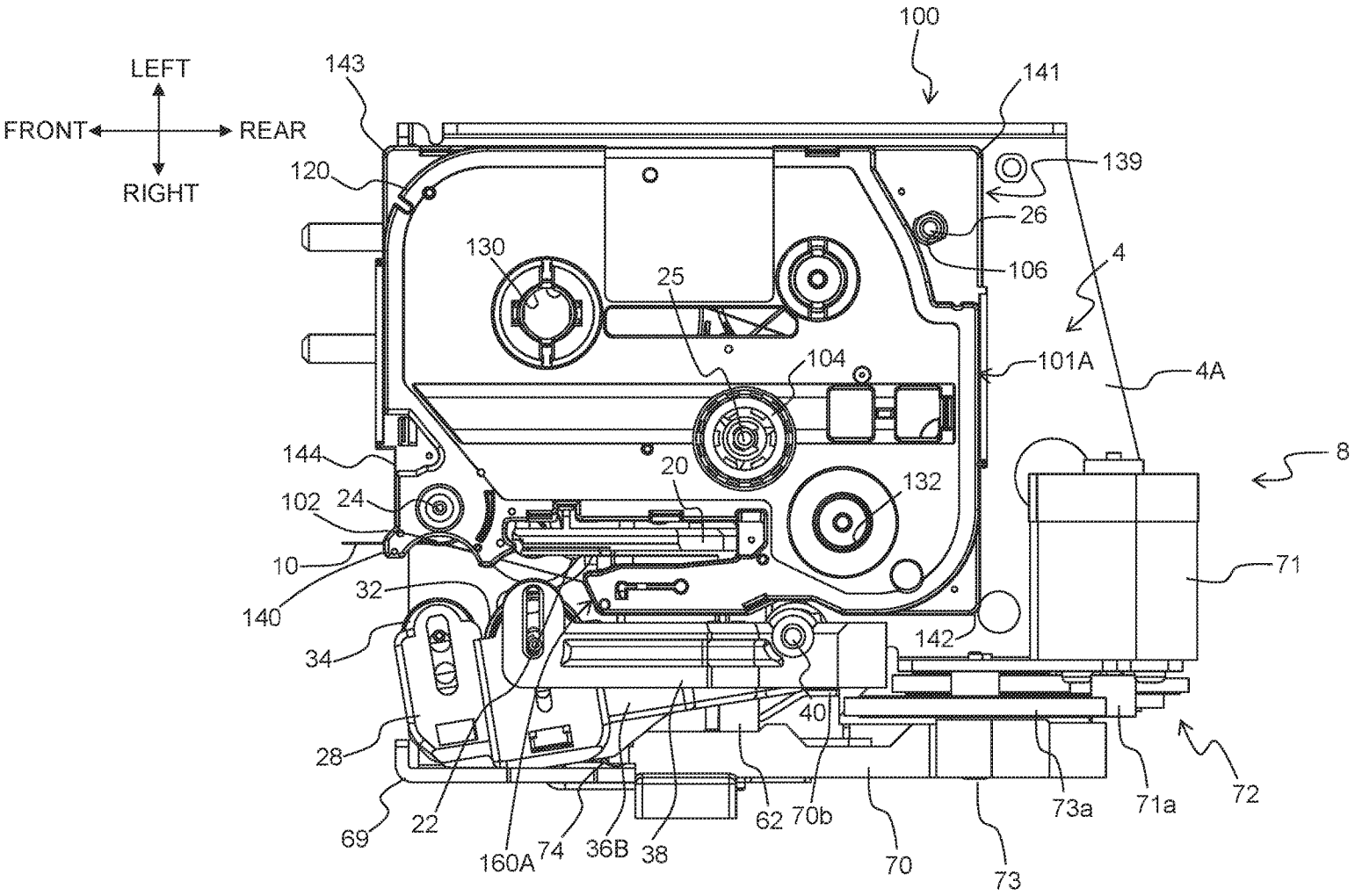
[FIG. 5]

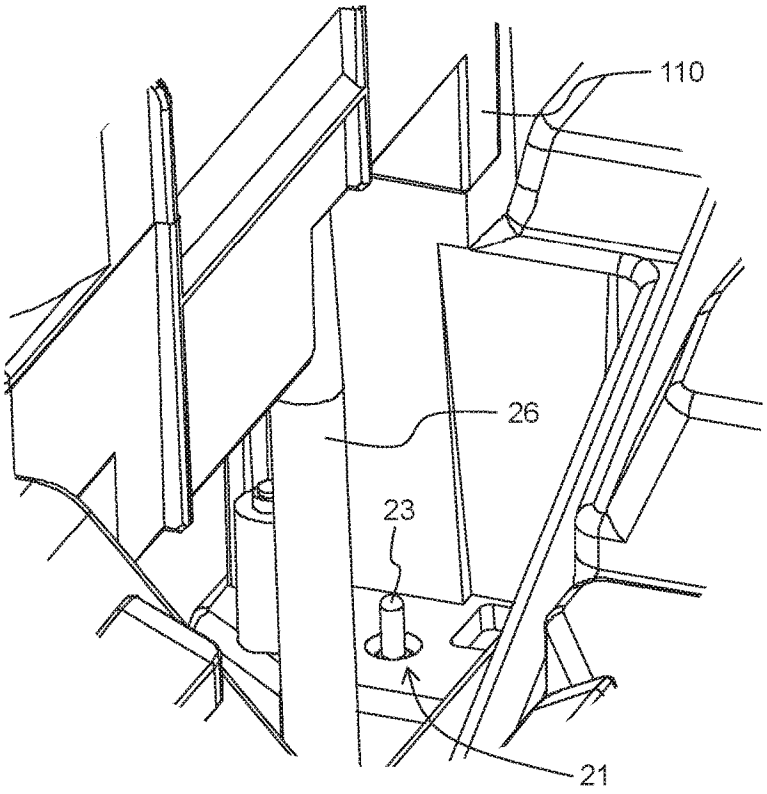
[FIG. 6]
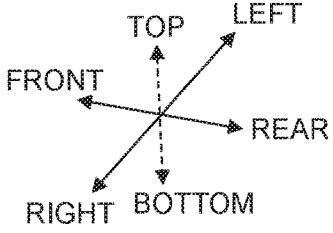

[FIG. 7A]
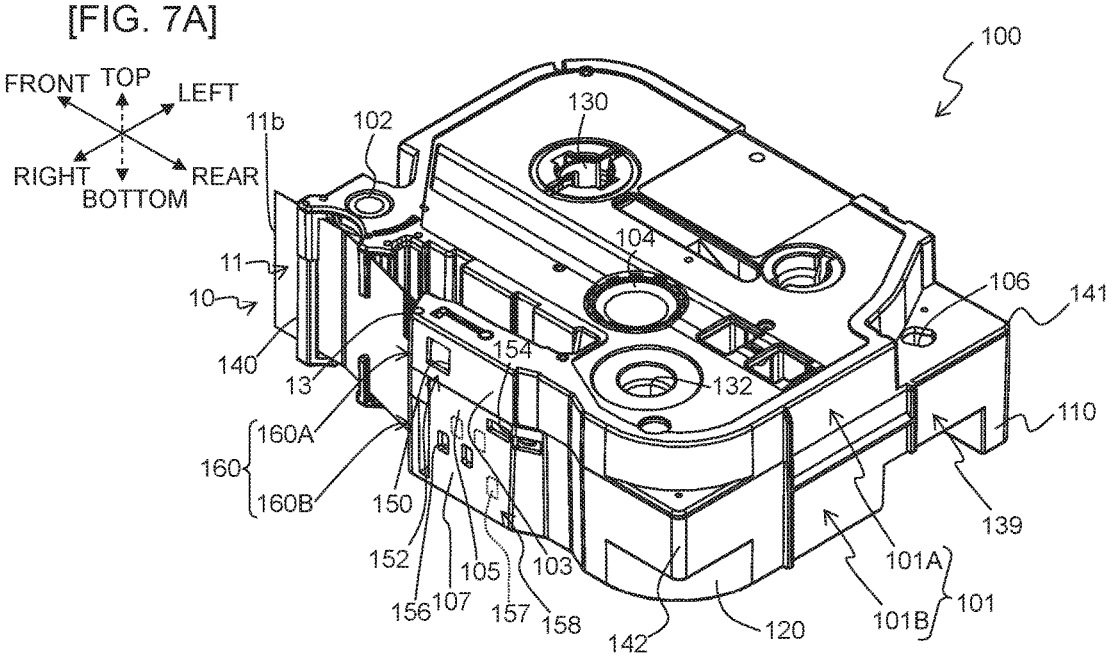
[FIG. 7B]
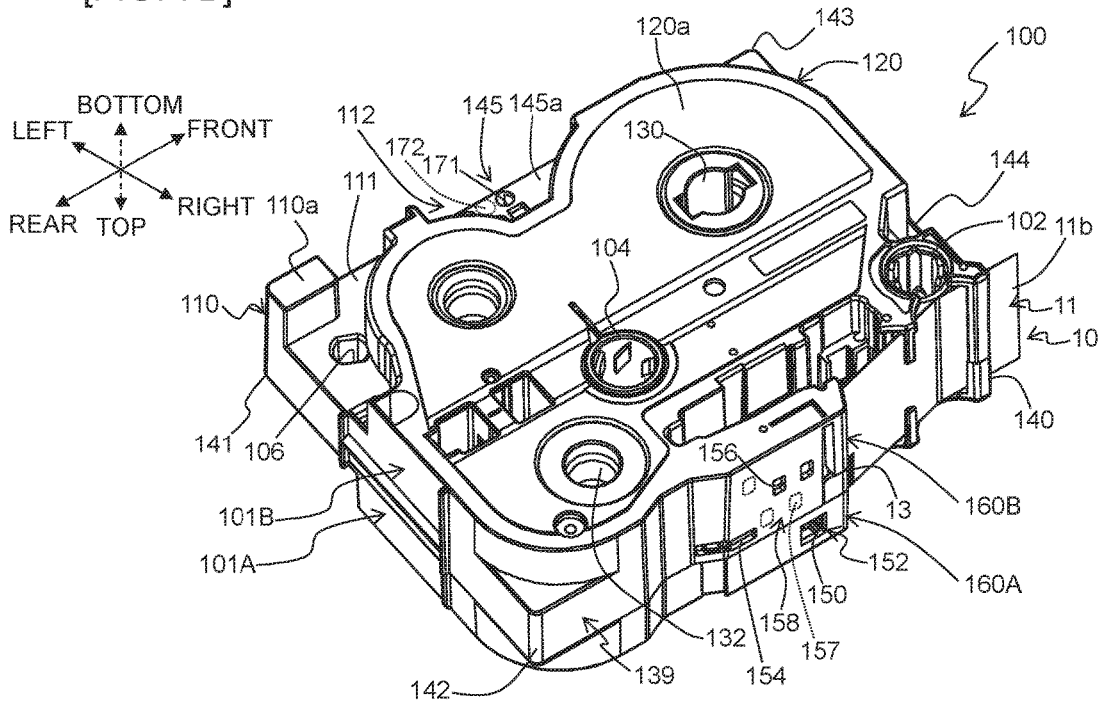

[FIG. 8]
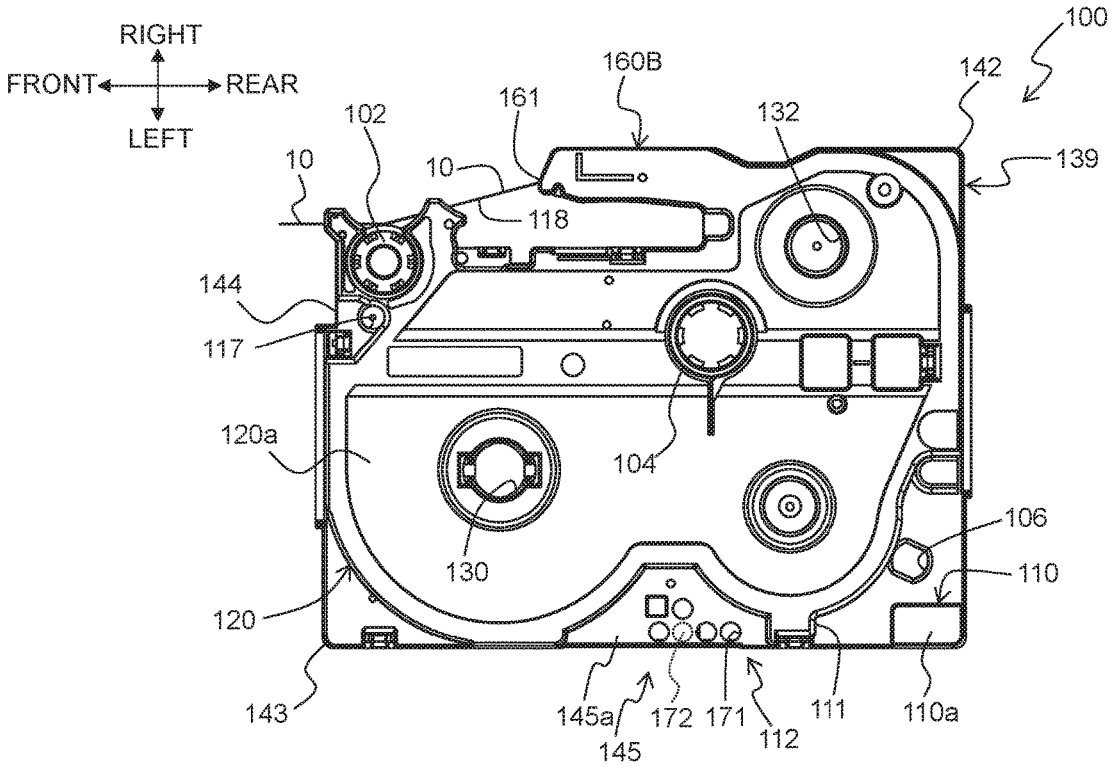

[FIG. 9A]
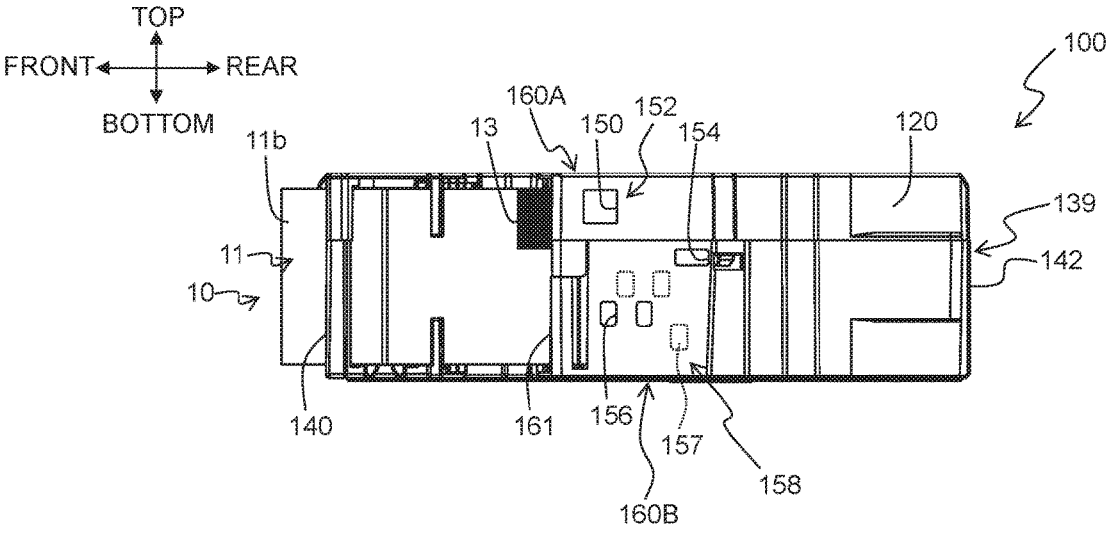
[FIG. 9B]
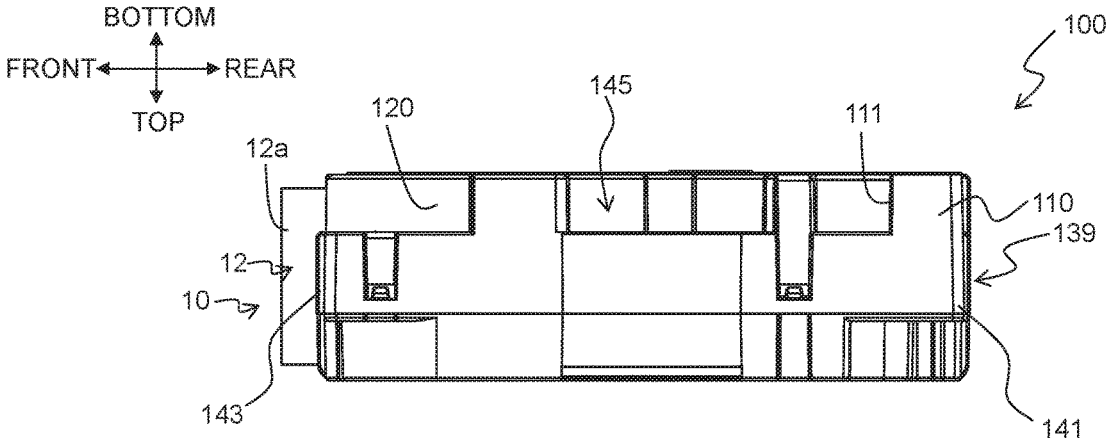

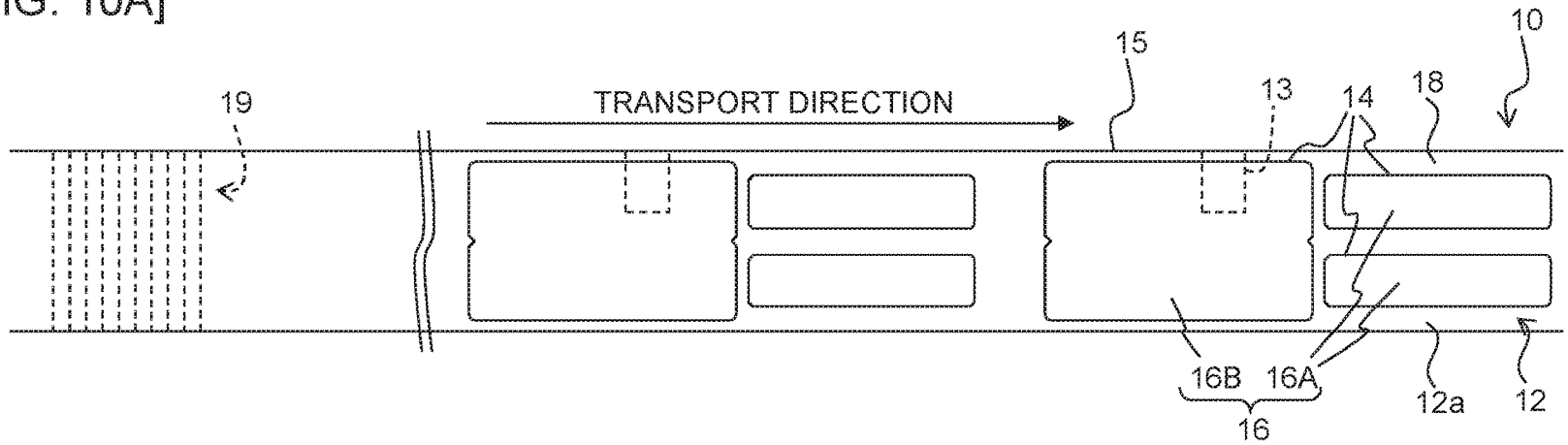
[FIG. 10A]
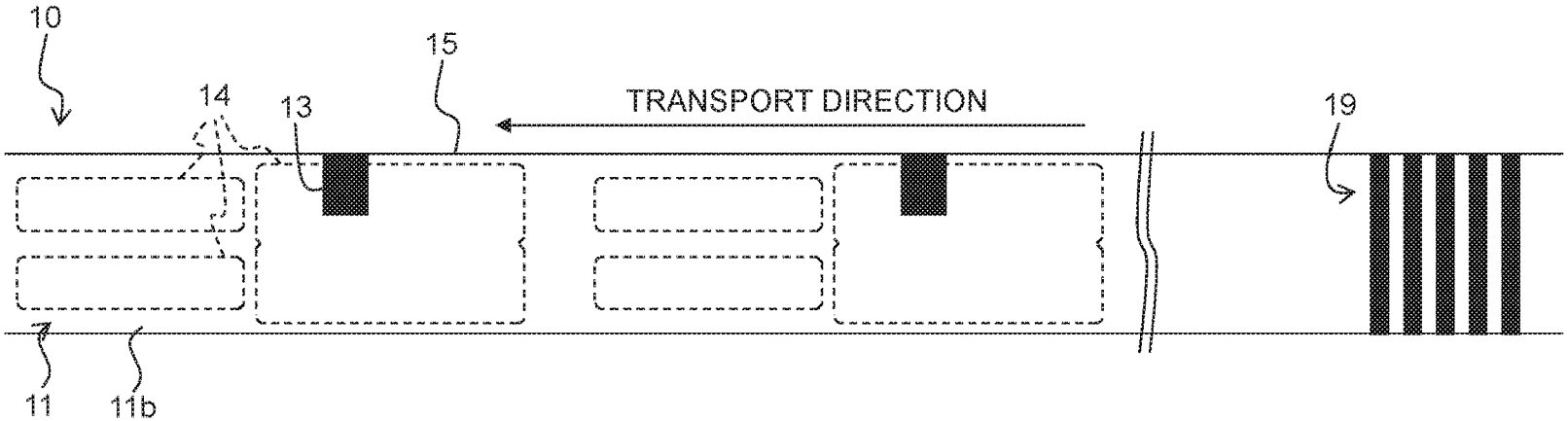
[FIG. 10B]

[FIG. 11A]
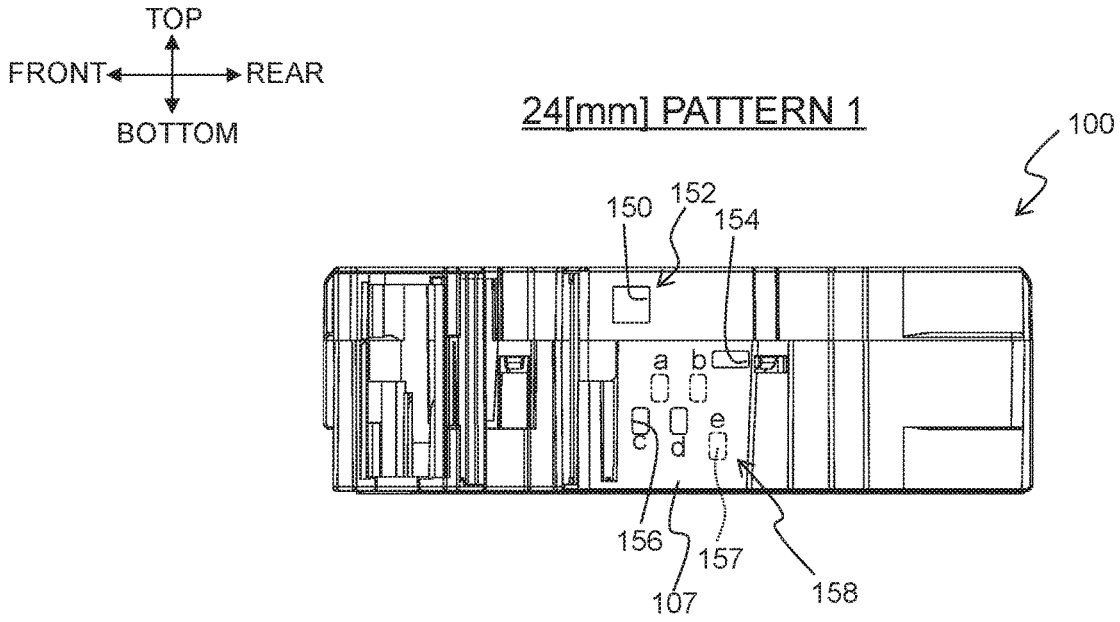
[FIG. 11B]
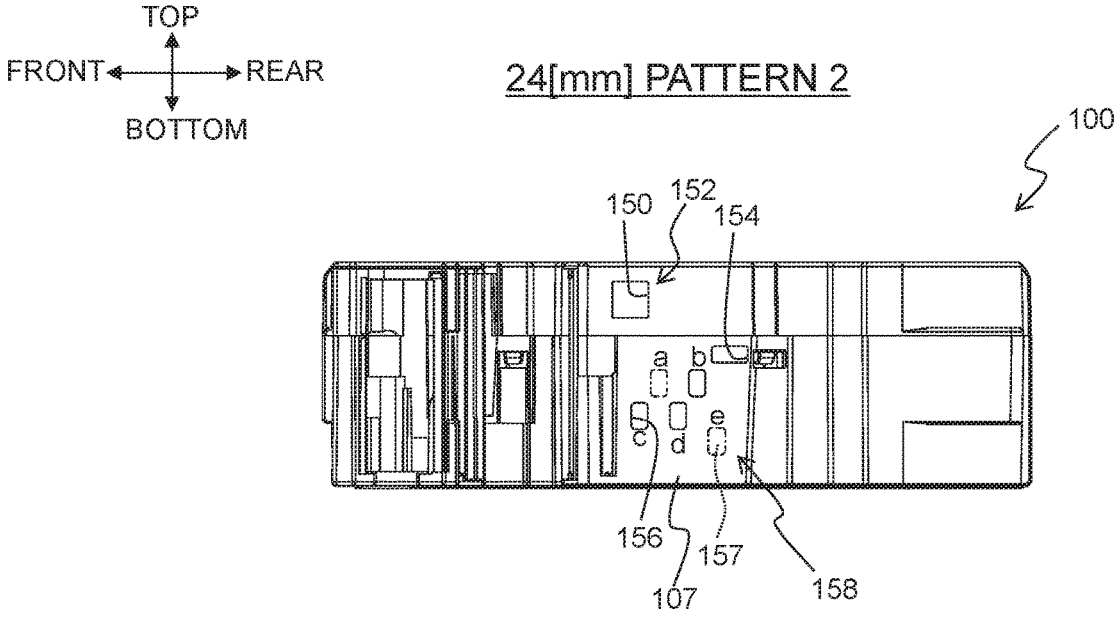

[FIG. 12A]
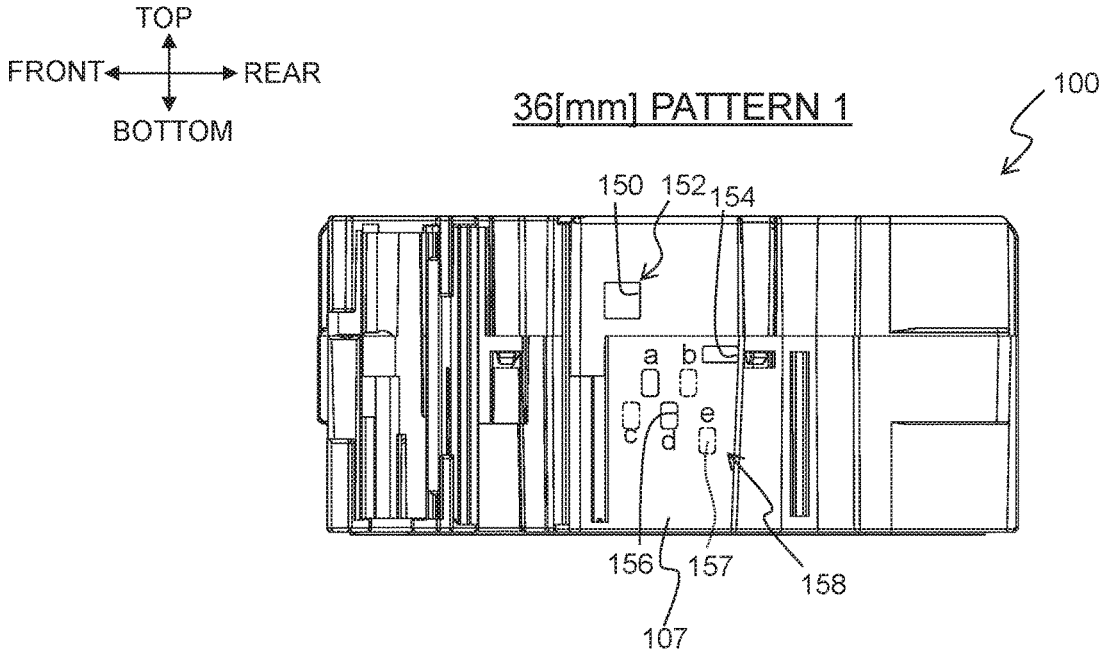
[FIG. 12B]
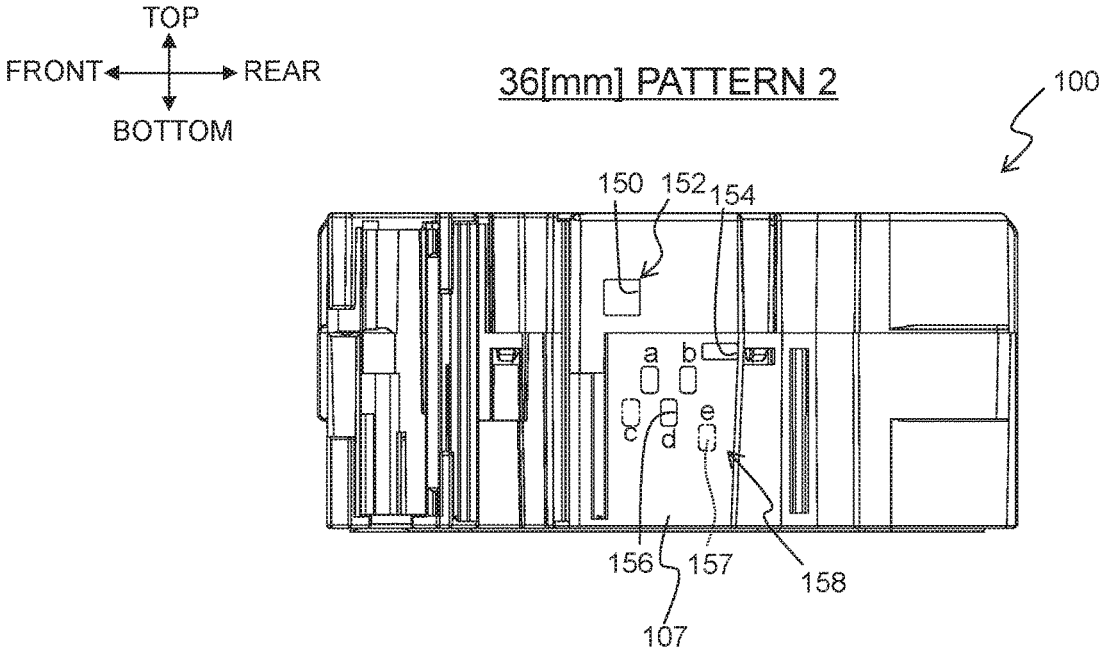

[FIG. 13A]
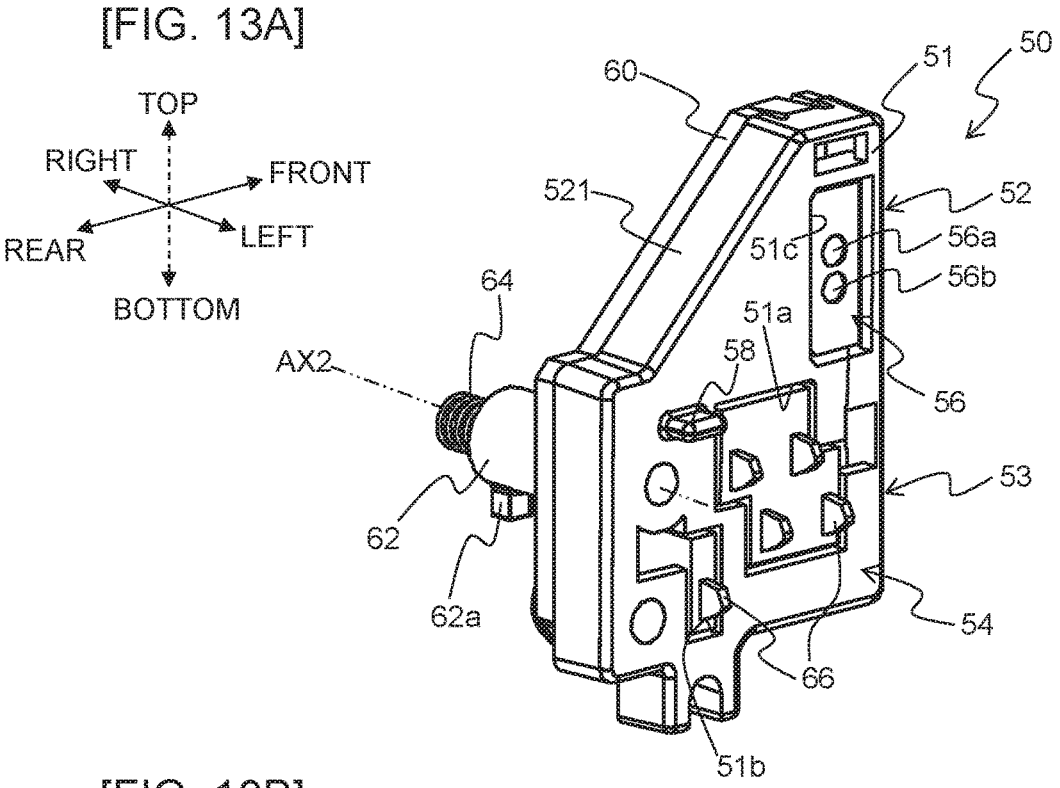
[FIG. 13B]
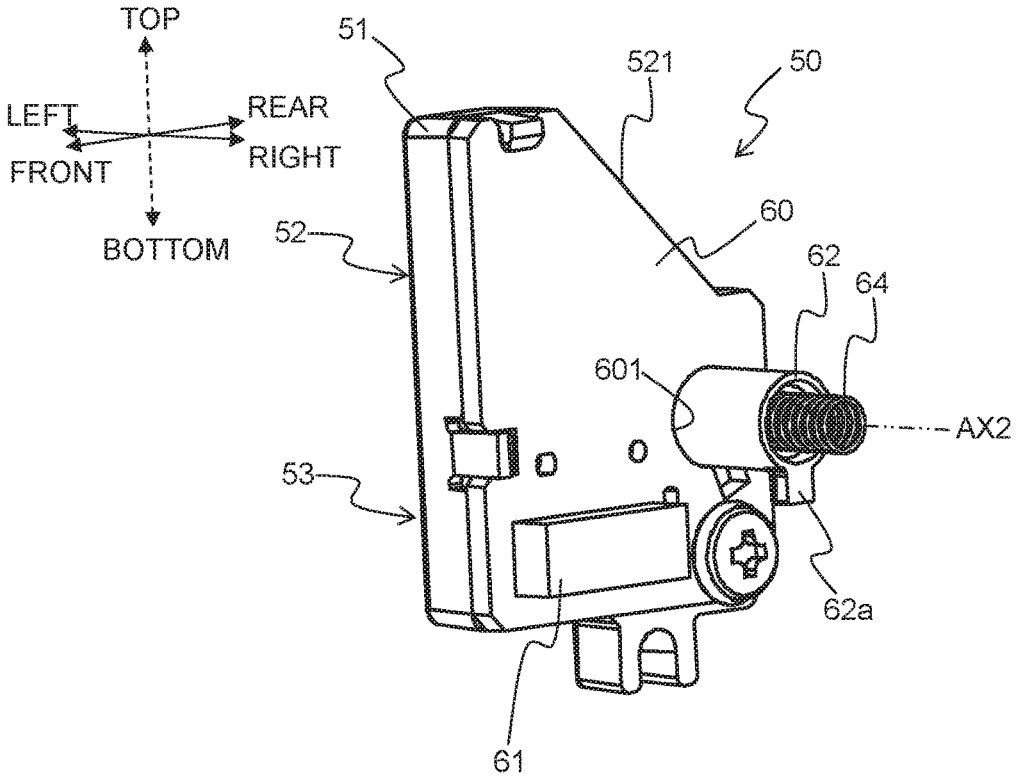

[FIG. 14]
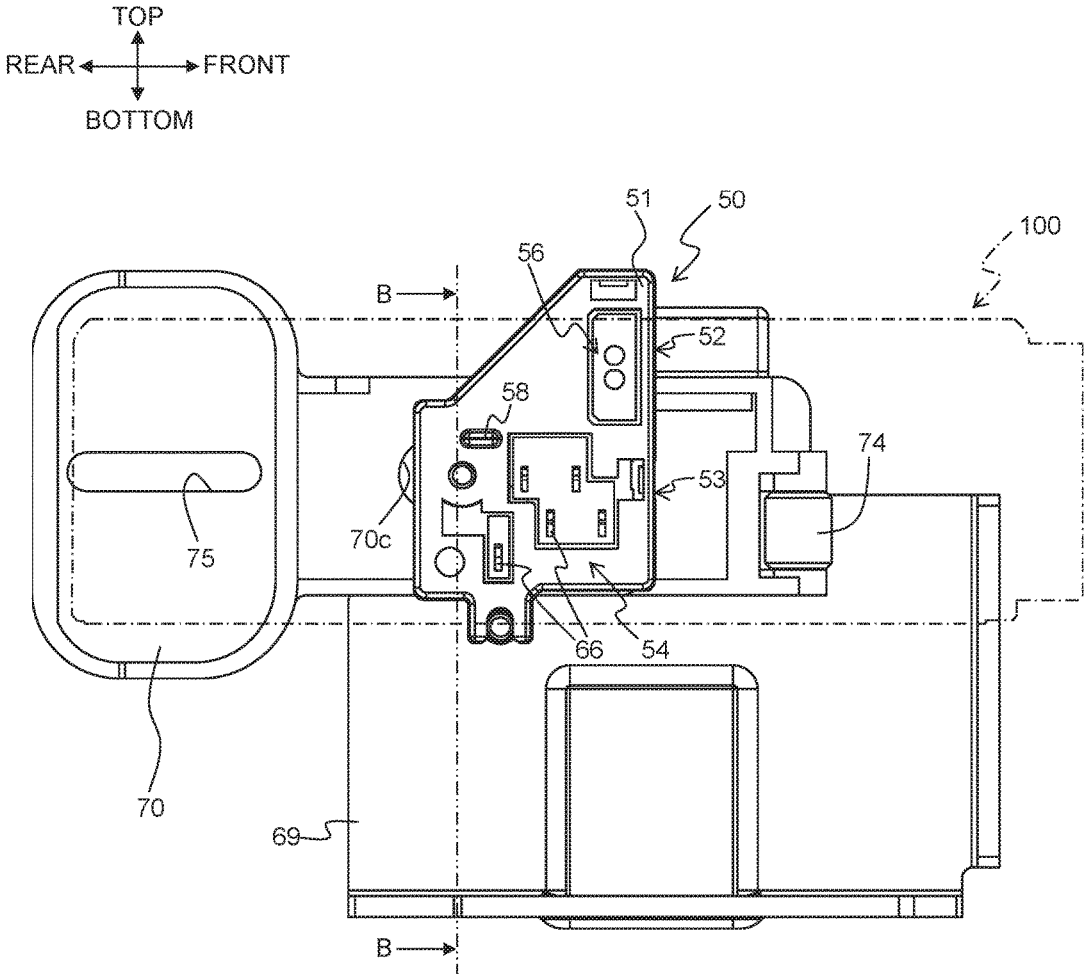

[FIG. 15]
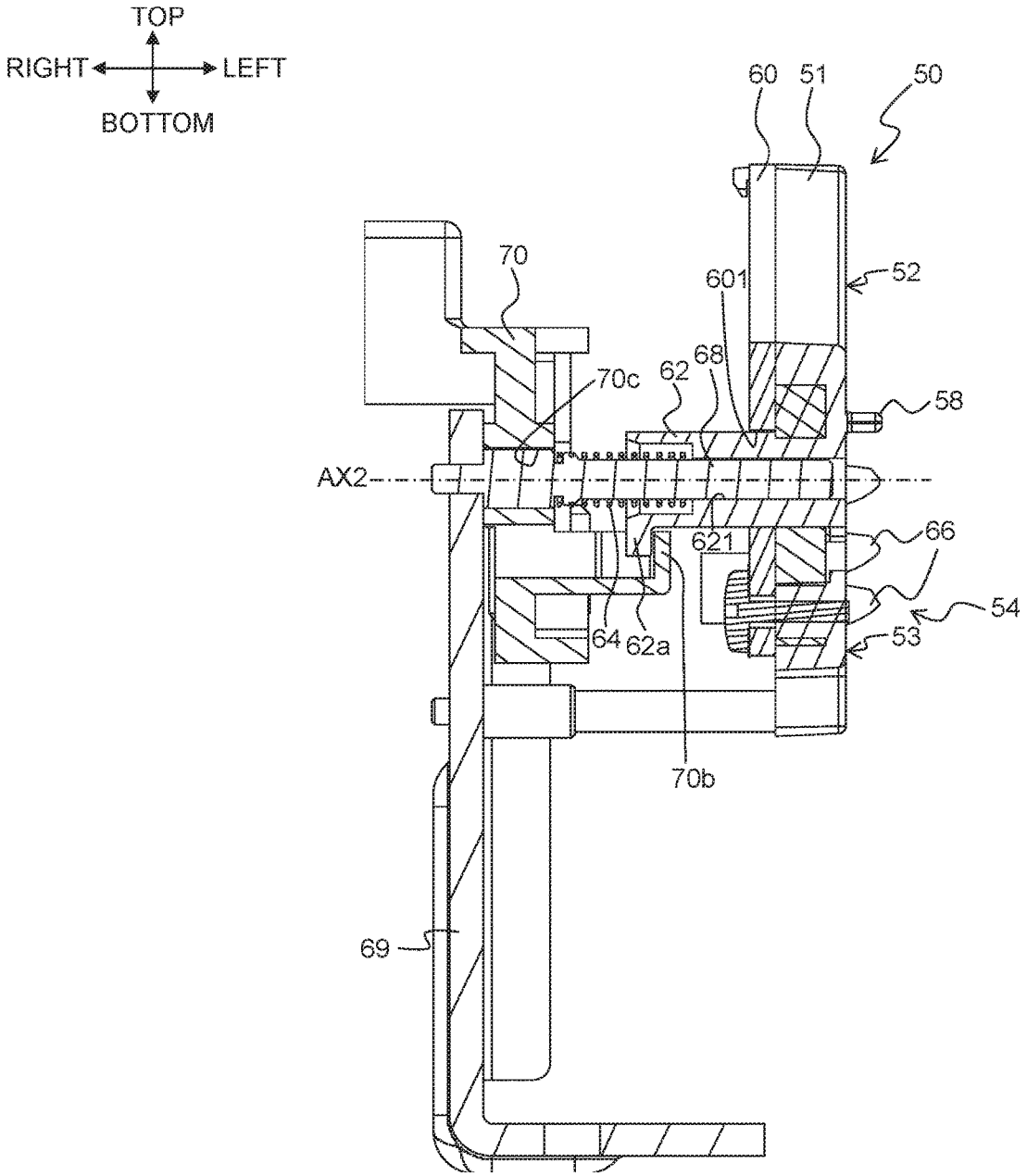

[FIG. 16]
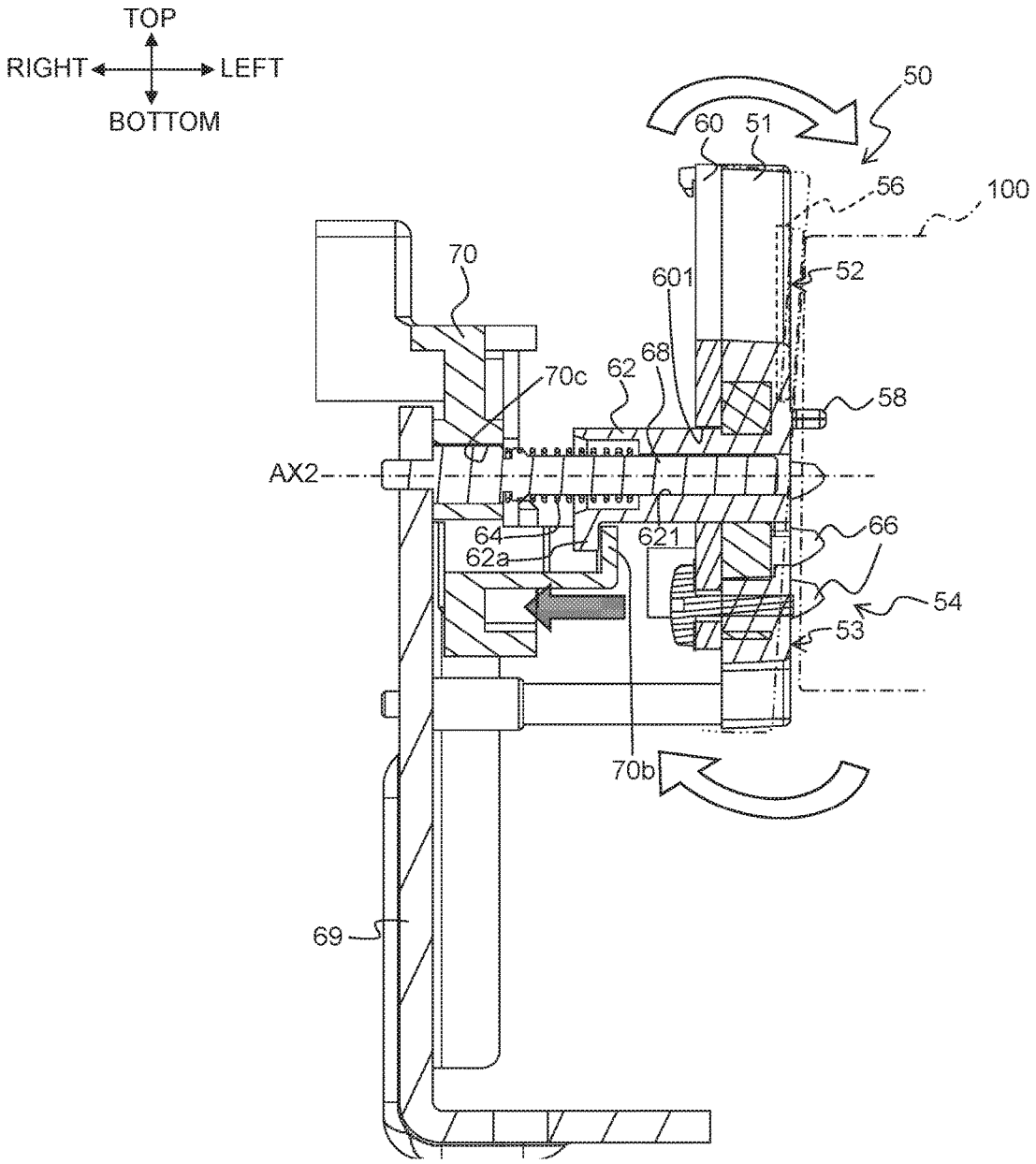

[FIG. 17]
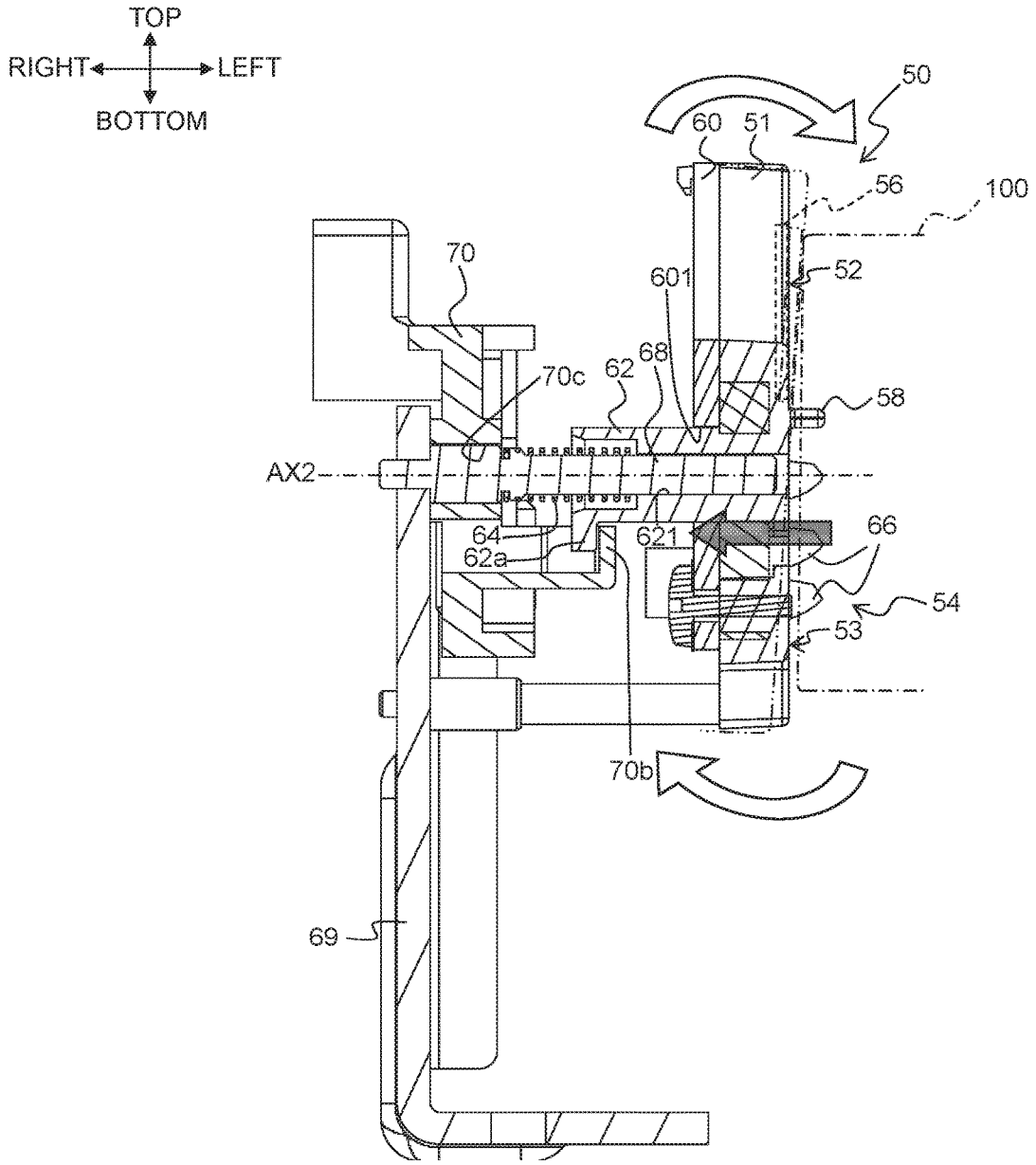

PRINTER AND TAPE CARTRIDGE

CROSS-REFERENCE TO RELATED APPLICATION

The present application is a divisional of prior U.S. application Ser. No. 15/216,021, filed Jul. 21, 2016, which claims priority from Japanese Patent Application No. 2015-146725, which was filed on Jul. 24, 2015, the disclosures of which are incorporated herein by reference in their entirety.

BACKGROUND

Field

The present disclosure relates to a printer printing a print-receiving medium supplied from a cartridge, and a tape cartridge able to be attached to the printer.

Description of the Related Art

A printer performing print on a print-receiving medium supplied from a cartridge is hitherto known. This printer (tape printer) has a cartridge holder (cartridge mounting frame) into which the cartridge (tape cartridge) is able to be attached and detached so that the printer can form print on various types of print-receiving media by replacing the cartridge.

In the case that various types of cartridges each having a variety of print-receiving media are selectively attached to the cartridge holder for use, as in the prior art, information related to the print-receiving medium attached to the cartridge needs to be correctly detected in order for the printer to perform a proper print. In the above prior art, an optical sensor (photosensor) is disposed that optically detects information related to the print-receiving medium on the cartridge.

In the case of performing the optical detection by the optical sensor, the distance to the cartridge as an object to be detected influences the detection accuracy to a great extent. If the optical detection is performed at the optimum distance, a high detection accuracy can be obtained, but the detection accuracy lowers according as the distance to the cartridge deviates further from the optimum distance. Thus, there is a need to perform a high-accuracy positioning of the optical sensor with respect to the cartridge.

SUMMARY

An object of the present disclosure is to provide a printer and a tape cartridge, capable of a high-accuracy optical detection on the cartridge by the optical sensor.

In order to achieve the above-described object, according to an aspect of the present application, there is provided a printer comprising a cartridge holder, a feeder, a printing head, a first sensor, and a second sensor. The cartridge holder is configured to attach and detach a medium cartridge having a print-receiving medium. The feeder is configured to feed the print-receiving medium supplied from the medium cartridge along a feeding path. The printing head is configured to form print on the print-receiving medium fed by the feeder. The first sensor is configured to bring a detector into contact with the medium cartridge and thereby detect first information related to the print-receiving medium, based on a result of the contact. The second sensor is configured to project light to the medium cartridge and thereby detect second information related to the print-receiving medium, based on a result of light reception corresponding to the projected light. The first sensor and the second sensor are integrated as a sensor unit configured to perform an advancing/retreating motion toward/from the medium cartridge.

The present disclosure uses not only the first sensor mechanically detecting the first information related to the print-receiving medium (e.g. the tape width of the print-receiving tape), but also the second sensor optically detecting the second information related to the print-receiving medium (e.g. the relative position of a label portion with respect to a printing head when using a print-receiving tape with a sheet separated into the label portion and a non-label portion by a cut).

The present disclosure is configured such that the second sensor is integrated with the first sensor performing a mechanical detection in accordance with the result of contact of a detector with an object to be detected, to form a sensor unit which can advance/retreat toward/from the medium cartridge. This enables the second sensor to perform an optical detection under the state where a high-accuracy positioning is achieved so that the distance from the second sensor to the medium cartridge is the optimum distance, as a result of the mechanical detection effected by the first sensor (detection by a contact with the medium cartridge that is an object to be detected). In consequence, the second sensor can reliably perform the optical detection of the second information of the medium cartridge at a high accuracy.

BRIEF DESCRIPTION OF DRAWINGS

FIG. 1 is a perspective view showing an external appearance of a printer in accordance with an embodiment of the present disclosure, with a cover removed.

FIG. 2 is a perspective view showing a configuration of an internal unit.

FIG. 3 is a plan view showing a configuration of the internal unit.

FIG. 4 is a sectional view showing a configuration of the internal unit.

FIG. 5 is a plan view showing a configuration of the internal unit.

FIG. 6 is an enlarged view of a portion A in FIG. 1.

FIG. 7A is a perspective view showing a configuration of a tape cartridge.

FIG. 7B is a perspective view showing a configuration of the tape cartridge.

FIG. 8 is a plan view showing a configuration of the tape cartridge.

FIG. 9A is a side view showing a configuration of the tape cartridge.

FIG. 9B is a side view showing a configuration of the tape cartridge.

FIG. 10A is a schematic view for explaining a structure of a print-receiving tape.

FIG. 10B is a schematic view for explaining a structure of the print-receiving tape.

FIG. 11A is an explanatory view for explaining an example of combination of insertion holes and face portions in a contact detected part.

FIG. 11B is an explanatory view for explaining an example of combination of the insertion holes and the face portions in the contact detected part.

FIG. 12A is an explanatory view for explaining an example of combination of the insertion holes and the face portions in the contact detected part.

FIG. 12B is an explanatory view for explaining an example of combination of the insertion holes and the face portions in the contact detected part.

FIG. 13A is a perspective view showing a configuration of a sensor unit.

FIG. 13B is a perspective view showing a configuration of the sensor unit.

FIG. 14 is a plan view showing the sensor unit and its peripheral configuration.

FIG. 15 is a sectional view taken along line B-B in FIG. 14.

FIG. 16 is an explanatory view showing the case where the sensor unit tries to tilt relative to a guide portion by a reaction force acting in a direction away from the tape cartridge.

FIG. 17 is an explanatory view showing the case where the sensor unit tries to tilt relative to a mechanical sensor by a reaction force acting in the direction away from the tape cartridge.

DETAILED DESCRIPTION OF THE PREFERRED EMBODIMENTS

An embodiment of the present disclosure will now be described with reference to the drawings. In the case that there are notes such as "front", "rear", "left", "right", "top", and "bottom" in the drawings, "front", "rear", "left", "right", "top", and "bottom" in the description of the specification refer to the noted directions.

<Schematic Configuration of Printer>

Referring first to FIG. 1, a schematic configuration of a printer of this embodiment will be described.

In FIG. 1, a printer 1 can selectively execute a print process on a print-receiving tape 10 and a print process on a print-receiving tube (not shown). The printer 1 may be configured to be able to execute only the print process on the print-receiving tape 10, without being limited to the configuration in which the print process on the print-receiving tape 10 and the print process on the print-receiving tube are both executable.

The printer 1 can use a tape cartridge 100 of various types such as thermal type, receptor type, and laminate type. In the following, the case of using the tape cartridge of the receptor type will be described. The printer 1 can use both types of tape cartridge 100, of a so-called die-cut label type in which a print-receiving sheet of the print-receiving tape 10 has a cut for division into a label portion and a non-label portion and of a type (hereinafter, referred to appropriately as "normal label type" in which the print-receiving sheet of the print-receiving tape 10 does not have the cut. In FIG. 1, the die-cut label type tape cartridge 100 is used.

The printer 1 has a substantially rectangular parallelepiped box-shaped body part 2 and a cover (not shown) to open and close an upper opening of the body part 2. Although the cover is shown removed from the body part 2 in FIG. 1, the cover is supported rotatably at an upper rear end of the body part 2 when the cover is attached to the body part 2.

A connector for power source or communication is disposed on a rear surface or a right surface of the body part 2. The printer 1 is connected via a cable, etc. (or by radio) to an operation terminal (not shown) of a personal computer, etc. to execute the print processes, based on user's operations of the operation terminal. The printer 1 may be configured (as a so-called stand-alone type) such that the print processes are executed based on operations of an appropriate operation part disposed on the printer 1, without being limited to the configuration executing the print processes based on operations of the operation terminal.

A cartridge holder 4 is disposed to a rightward position on a top surface of the body part 2, the cartridge holder 4 being a recessed region into which the tape cartridge 100 having the print-receiving tape 10 is removably fitted. FIG. 1 shows the tape cartridge 100 disposed to a position above the position to fit the tape cartridge 100 in the cartridge holder 4.

A discharging exit 6 is disposed to a rightward position on a front surface of the body part 2. The discharging exit 6 is an opening through which the print-receiving tape 10 after print formation by a thermal head 22 described later is discharged from the cartridge holder 4 to the exterior of the printer 1 while being transported by a platen roller 32, etc. described later.

<Internal Structure of Printer>

An internal structure of the printer 1 will then be described with reference to FIGS. 2 to 6. FIGS. 2 to 5 show the tape cartridge 100 disposed to a position (below the position of FIG. 1) above the position to fit the tape cartridge 100 in the cartridge holder 4, similar to FIG. 1. In FIGS. 2 to 5, the die-cut label type tape cartridge 100 is used.

In FIGS. 2 to 6, an internal unit 8 is disposed to a rightward position inside the body part 2. The internal unit 8 has a bottom plate 4A constituting a bottom of the cartridge holder 4.

<Cartridge Holder and its Periphery>

A head holder 20 vertically extends in the cartridge holder 4 at a rightward position on a substantially central portion in the front-to-rear direction thereof. The head holder 20 is made of a single plate-like member extending in the front-to-rear direction. The thermal head 20 having a heat-generating element (not shown) is disposed on a right surface of the head holder 20. The thermal head 22 prints (forms print on) the print-receiving tape 10 supplied from the tape cartridge 100 and transported along a predetermined feeding path by the platen roller 32, etc. described later.

A ribbon take-up shaft 25 vertically extends on the left side of the head holder 20 in the cartridge holder 4. The ribbon take-up shaft 25 is inserted into the interior of a ribbon take-up roller 104 described later disposed in the tape cartridge 100, to rotationally drive the ribbon take-up roller 104. A feed roller drive shaft 24 vertically extends in the cartridge holder 4 at a position in front of the head holder 20, downstream of the thermal head 22 (toward the discharging exit 6) in the feeding direction along the feeding path. The feed roller drive shaft 24 is inserted into the interior of a feed roller 102 described later disposed in the tape cartridge 100, to rotationally drive the feed roller 102.

A pin 26 vertically extends in the cartridge holder 4 in the vicinity of a left rearward corner thereof. The pin 26 extends through (is inserted through) a through-hole described later disposed in the tape cartridge 100, to act as a pin for stopping rotation of the tape cartridge 100. A pin 27 vertically extends on the left side of the feed roller drive shaft 24 in the cartridge holder. The pin 27 is inserted into an insertion hole 117 described later disposed in the tape cartridge 100, to function as a reference pin for positioning the tape cartridge 100.

A drive motor (not shown) in the form of a stepping motor is disposed outside the cartridge holder 4 in the body part 2. The ribbon take-up shaft 25 (the ribbon take-up roller 104), the feed roller drive shaft 24 (the feed roller 102), and the platen roller 32 described later are connected via a plurality of gears not shown to the drive motor to rotate with the drive of the drive motor.

<Structure of Die-Cut Label Type Tape Cartridge>

A structure of the die-cut label type tape cartridge 100 will be described hereinbelow with reference to FIGS. 2 to 5, 7A and 7B, 8, and 9A and 9B.

In FIGS. 2 to 5, 7A and 7B, 8, and 9A and 9B, the die-cut label type tape cartridge 100 has a substantially rectangular parallelepiped housing 101. The housing 101 includes an upper first case part 101A and a lower second case part 101B. The case parts 101A and 101B are integrally fixed together.

The housing 101 has a roll storing part 120 shaped so as to at least partly conform to the contours of a print-receiving tape roll 122 described later. The roll storing part 120 stores the print-receiving tape roll 122 and a ribbon supplying roll 124.

At a left front of the roll storing part 120, the print-receiving tape roll 122 is rotatably supported by a support hole 130. The print-receiving tape 10 is wound in the print-receiving tape roll 122.

<Structure of Print-Receiving Tape>

A structure of the print-receiving tape 10 will be described below with reference to FIGS. 10A and 10B.

In FIGS. 10A and 10B, the print-receiving tape 10 has an elongated strip-shaped separation sheet 11 having a separation property and an elongated strip-shaped print-receiving sheet 12 separably affixed to a surface (surface on the back side of paper in FIG. 10B) of the separation sheet 11. The print-receiving tape 10 is wound in the print-receiving tape roll 122 in such a manner that a surface 12*a* (surface on the front side of paper in FIG. 10A) of the print-receiving sheet 12 opposite to the separation sheet 11 lies on the inner peripheral side while a back surface 11*b* (surface on the front side of paper in FIG. 10B) of the separation sheet 11 opposite to the surface lies on the outer peripheral side.

The print-receiving sheet 12 has a width substantially equal to the separation sheet 11 and is separably affixed to the surface of the separation sheet 11 by a proper adhesive disposed on a back surface (surface on the back side of paper in FIG. 10A) opposite to the surface 12*a*. The print-receiving sheet 12 is a sheet on which an ink ribbon 118 described later is overlaid so that print is formed thereon by thermal transfer of ink. The print-receiving sheet 12 has a cut 14 formed by a so-called half-cut process, by which cut 14 it is divided into a label portion 16 acting as a print label after print formation that is affixed by the adhesive on the back surface to an object to be affixed (not shown) such as a cable, and a remaining non-label portion 18.

In this example, the label portions 16 are formed on the print-receiving sheet 12 at predetermined intervals along the feeding direction (longitudinal direction of the print-receiving tape 10), each label portion 16 including two wound portions 16A to be wound around the periphery of the object to be affixed and a label body portion 16B on which print is formed. The two wound portions 16A each have a substantially rectangular shape elongated in the feeding direction and are arranged side by side along the width direction of the print-receiving tape 10. The label body portion 16B has a widened substantially rectangular shape and is disposed upstream of the two wound portions 16A in the feeding direction. The form of the label portion 16 in the print-receiving sheet 12 is not limited to the above and may be another one.

Corresponding to the position of the label portion 16, a substantially rectangular black mark 13 is formed by printing on the back surface 11*b* of the separation sheet 11 at predetermined intervals along the feeding direction. At a position corresponding to each label portion 16 along the feeding direction (in this example, position slightly downstream of a center in the feeding direction of each label body portion 16B), the black mark 13 is formed on the back surface 11*b* of the separation sheet 11 in the vicinity of an edge 15 on one side (upper side in FIGS. 10A and 10B) in width direction of the print-receiving tape 10, the black mark 13 facing a through-hole 150 described later disposed in a right wall 103 of the first case part 101A (see also FIG. 9A, etc.). The black mark 13 may be formed on the back surface 11*b* of the separation sheet 11 at a position not corresponding to each label portion 16 along the feeding direction. The size of the black mark 13 is formed larger than that of the through-hole 150 (see also FIG. 9A, etc.).

A checkered end mark 19 is formed by printing on the back surface 11*b* of the separation sheet 11 in the vicinity of a terminal end in the feeding direction.

Referring back to FIGS. 2 to 5, 7A and 7B, 8, and 9A and 9B, the ribbon supplying roll 124 is rotatably supported by a support hole 132 in the right rear of the roll storing part 120. The ink ribbon 118 is wound in the ribbon supplying roll 124.

The ribbon take-up roller 104 is pivotally supported between the print-receiving tape roll 122 and the ribbon supplying roll 124 in the housing 101. The ribbon take-up roller 104 is rotationally driven by the ribbon take-up shaft 25 fitted thereinto as a result of attaching of the tape cartridge 100 into the cartridge holder 4. The ribbon take-up roller 104 draws out the ink ribbon 118 from the ribbon supplying roll 124 and takes up the used ribbon 118.

The housing 101 has an arm portion 160 extending frontward from the right rear of the roll storing part 120. The arm portion 160 includes a first arm portion 160A of the first case part 101A and a second arm portion 160B of the second case part 101B.

The print-receiving tape 10 drawn out from the print-receiving tape roll 122 is guided in the arm portion 160, with its width direction providing the top-to-bottom direction, the surface 12*a* of the print-receiving sheet 12 lying on the right side, and the back surface 11*b* of the separation sheet 11 lying on the left side. The ink ribbon 118 drawn out from the ribbon supplying roll 124 is guided on the left side of the print-receiving tape 10 in the arm portion 160, with its width direction providing the top-to-bottom direction. The print-receiving tape 10 and the ink ribbon 118 introduced into the arm portion 160 are guided frontward and overlaid together at a front-end opening 161 of the arm portion 160 to be discharged frontward of the arm portion 160.

The feed roller 102 is pivotally supported at a position in front of the arm portion 160 in the housing 101. The feed roller 102 is rotationally driven by the feed roller drive shaft 24 fitted thereinto as a result of attaching of the tape cartridge 100 into the cartridge holder 4. The feed roller 102 draws out the print-receiving tape 10 from the print-receiving tape roll 122 in cooperation with a pressure roller 34 described later disposed facing the feed roller 102, and transports the print-formed print-receiving tape 10 toward the discharging exit 6 via a discharge guide part 140 disposed to a right front corner of the housing 101. The ink ribbon 118 is guided toward the ribbon take-up roller 104 on the upstream side in the feeding direction of the feed roller 102.

The first case part 101A has the right wall 103 of the first arm portion 160A. The second case part 101B has a first right wall 105 of the second arm portion 160B below the right wall 103 of the first arm portion 160A and has a second right wall 107 of the second arm portion 160B below the first right wall 105.

The right wall 103 of the first arm portion 160A includes an optically detected part 152 having the through-hole 150 of a substantially rectangular shape, at a portion facing a movement path of the black mark 13 on the back surface 11*b* of the separation sheet 11 disposed on the print-receiving tape 10 passing through the interior of the arm portion 160 frontward from the rear side. The through-hole 150 is used for optically detecting the black mark 13 by an optical sensor 56 described later included in the body part 2 of the printer 1 (the details will be described later). In this example, the through-hole 150 is disposed in the right wall 103 substantially at a center in the top-to-bottom direction closer to the front.

The second right wall 107 of the second arm portion 160B includes a contact detected part 158 indicating information related to the print-receiving tape 10 of the tape cartridge 100. The contact detected part 158 has at least one substantially rectangular insertion hole 156 formed in the second right wall 107 and defines information related to the print-receiving tape 10 of the tape cartridge 100 by the combination of the insertion holes 156 and face portions 157. The insertion hole 156 is a hole allowing insertion of a sensor protrusion 66 described later disposed on the body part 2 of the printer 1, the insertion hole 156 functioning as a non-contact portion (non-pressing portion) with which the sensor protrusion 66 does not come into contact (or which does not press the sensor protrusion 66) when the tape cartridge 100 is attached to the cartridge holder 4. The face portion 157 functions as a contact portion (pressing portion) with which the sensor protrusion 66 comes into contact (or which presses the sensor protrusion 66) when the tape cartridge 100 is attached to the cartridge holder 4. In this embodiment, the contact detected part 158 defines information of a tape width of the print-receiving tape 10 of the tape cartridge 100 by the combination of the insertion holes 156 and the face portions 157. A plurality of the insertion holes 156, whose number and arrangement depend on the tape width, are formed in the second right wall 107 (the details will be described later).

The first right wall 105 of the second arm portion 160B has a substantially rectangular insertion hole 154. The position of the insertion hole 154 in the front-to-rear direction is rearward, i.e. upstream, in the feeding direction of the print-receiving tape 10 in the arm portion 160 (in other words, in the movement direction of the black mark 13), of the position of the through-hole 150 in the front-to-rear direction and of the position of the insertion hole 156 in the front-to-rear direction. The insertion hole 154 is a hole guiding an advance/retreat of a sensor unit 50 described later included in the body part 2 of the printer 1, into which a guide protrusion 58 described later disposed on the sensor unit 50 is inserted when the sensor unit 50 moves to a detection position described later with the tape cartridge 100 being attached to the cartridge holder 4 (the details will be described later).

The housing 101 includes a flange 139 and a recessed portion 111 on the outer peripheral side of the roll storing part 120 along the front-to-rear direction and the left-to-right direction, the flange 139 having a substantially flat-plate-shaped contour smaller than the dimension in the top-to-bottom direction of the roll storing part 120. The flange 139 has four corner portions 141 to 144 shaped to be of substantially the same top-to-bottom dimension, and an intermediate portion 145 disposed substantially at a center in the front-to-rear direction on the left side of the roll storing part 120.

The corner portion 141 is a left rear corner portion of the flange 139, the corner portion 142 is a right rear corner portion of the flange 139, the corner portion 143 is a left front corner portion of the flange 139, and the corner portion 144 is the right front corner portion of the flange 139. The corner portions 141 to 143 protrude outward from side surfaces of the roll storing part 120 so as to be substantially perpendicular in a planar view. The corner portion 144 is not perpendicular in a planar view because the discharge guide part 140 is disposed to the corner.

A through-hole 106 and an insertion hole 117 are disposed in the vicinity of each of the corner portions 141 and 144 located on a diagonal, among the corner portions 141 to 144. The through-hole 106 is a hole into which the pin 26 is inserted when the tape cartridge 100 is attached to the cartridge holder 4. The insertion hole 117 is a hole into which the pin 27 is inserted when the tape cartridge 100 is attached to the cartridge holder 4.

The corner portion 141 has a protruding portion 110.

The protruding portion 110 is a portion protruded downward partly from the corner portion 141. The position in the top-to-bottom direction of a lower end 110*a* of the protruding portion 110 is below an undersurface 145*a* of the intermediate portion 145. The position in the front-to-rear direction of the protruding portion 110 is substantially the same as the position in the front-to-rear direction of the through-hole 106. The protruding portion 110 expresses, by its presence, that the print-receiving tape 10 of the tape cartridge 100 is the print-receiving tape 10 having the separation sheet 11 and the print-receiving sheet 12 (in other words, the tape cartridge 100 is the die-cut label type). The protruding portion 110 acts as a depressing portion that depresses a sensor protrusion 23 described later disposed on the bottom of the cartridge holder 4 when the tape cartridge 100 is attached to the cartridge holder 4.

The recessed portion 111 is disposed to a position adjacent to the protruding portion 110 in the front-to-rear direction. The position in the top-to-bottom direction of the recessed portion 111 is substantially the same as the position in the top-to-bottom direction of a lower end of an undersurface of the flange 139.

The intermediate portion 145 has, on its undersurface 145*a*, a contact detected part 112 expressing information related to the tape cartridge 100. The contact detected part 112 has at least one substantially circular insertion hole 171 formed in the undersurface 145*a* second right wall 107 and defines information related to the tape cartridge 100 by the combination of the insertion holes 171 and face portions 172. The insertion hole 171 is a hole allowing insertion of a sensor protrusion 63 described later disposed on the body part 2 of the printer 1, the insertion hole 171 functioning as a non-contact portion (non-depressing portion) with which the sensor protrusion 63 does not come into contact (or which does not depress the sensor protrusion 63) when the tape cartridge 100 is attached to the cartridge holder 4. The face portion 172 functions as a contact portion (depressing portion) with which the sensor protrusion 63 comes into contact (or which depresses the sensor protrusion 63) when the tape cartridge 100 is attached to the cartridge holder 4. In this embodiment, the contact detected part 112 defines information of a shape of the label portion 16 of the print-receiving tape 10 of the tape cartridge 100 by the combination of the insertion holes 171 and the face portions 172, with the insertion holes 171 being formed on the undersurface 145*a* in number and arrangement corresponding to the shape of the label portion 16. The insertion hole 171 includes at least one hole whose position in the left-to-right direction is substantially the same as the position in the left-to-right direction of the protruding portion 110.

<Exemplary Combination of Insertion Holes and Face Portions in Contact Detected Part>

An exemplary combination of the insertion holes 156 and the face portions 157 in the contact detected part 158 will be described hereinbelow with reference to FIGS. 11A, 11B, 12A, and 12B. The print-receiving tape 10 is not shown in FIGS. 11A, 11B, 12A, and 12B. In FIGS. 11A, 11B, 12A, and 12B, reference letters a, b, c, d, and e are imparted to positions facing five sensor protrusions 66 described later disposed in the body part 2 of the printer 1 when the tape cartridge 100 is attached to the cartridge holder 4.

FIG. 11A shows the die-cut label type tape cartridge 100 having the print-receiving tape 10 whose tape width is a predetermined first tape width (24 [mm] in this example). The tape cartridge 100 shown in FIG. 11A is the same as the tape cartridge 100 shown in FIGS. 1 to 9. Such a die-cut label type tape cartridge 100 having the print-receiving tape 10 whose tape width is the first tape width (24 [mm] in this example) has a position in the top-to-bottom direction of the lower end 11*a* of the protruding portion 110 substantially equal to the position in the top-to-bottom direction of a lower end 120*a* of the roll storing part 120.

The tape cartridge 100 shown in FIG. 11A has the insertion holes 156 formed in the second right wall 107 at positions designated by reference letters c and d and has the face portions 157 formed thereon at positions designated by reference letters a, b, and e. The insertion hole 156 formed at the position designated by reference letter c and the insertion hole 156 formed at the position designated by reference letter d are arranged (side by side) at positions different in the front-to-rear direction and at positions substantially the same in the top-to-bottom direction. The insertion hole 156 formed at the position designated by reference letter c lies at a position in the front-to-rear direction substantially the same as that of (is vertically aligned with) the through-hole 150.

FIG. 11B shows the die-cut label type tape cartridge 100 having the print-receiving tape 10 whose tape width is the first tape width (24 [mm] in this example) but having a pattern of combination of the insertion holes 156 and the face portions 157 in the contact detected part 158, different from that of the tape cartridge 100 shown in FIG. 11A.

The tape cartridge 100 shown in FIG. 11B has the insertion holes 156 formed in the second right wall 107 at positions designated by reference letters b, c, and d and has the face portions 157 formed thereon at positions designated by reference letters a and e. That is, the tape cartridge 100 shown in FIG. 11B has the insertion hole 156 at the position designated by reference letter b which designates the position of the face portion 157 in the tape cartridge 100 shown in FIG. 11A. The insertion hole 156 formed at the position designated by reference letter b, the insertion hole 156 formed at the position designated by reference letter c, and the insertion hole 156 formed at the position designated by reference letter d are arranged in an array state (a so-called staggered array) in which those positions in the front-to-rear direction differ from one another and those positions in the top-to-bottom direction differ from one another.

FIG. 12A shows the die-cut label type tape cartridge 100 having the print-receiving tape 10 whose tape width is a predetermined second tape width (36 [mm] in this example) that is greater than the first tape width.

The tape cartridge 100 shown in FIG. 12A has the insertion holes 156 formed in the second right wall 107 at positions designated by reference letters a and d and has the face portions 157 formed thereon at positions designated by reference letters b, c, and e. That is, the tape cartridge 100 shown in FIG. 12A has the face portion 157 at the position designated by reference letter a which designates the position of the insertion hole 156 in the tape cartridge 100 shown in FIG. 11A, and has the insertion hole 156 at the position designated by reference letter c which designates the position of the face portion 157 therein. The respective positions in the front-to-rear direction of the two insertion holes 156 formed at the positions designated by reference letters a and d differ from the position in the front-to-rear direction of the through-hole 150 (are positioned rearward of the through-hole 150). The insertion hole 156 formed at the position designated by reference letter a and the insertion hole 156 formed at the position designated by reference letter d are arranged in an array state (the so-called staggered array) in which those positions in the front-to-rear direction differ from each other and those positions in the top-to-bottom direction differ from each other.

FIG. 12B shows the die-cut label type tape cartridge 100 having the print-receiving tape 10 whose tape width is the second tape width (36 [mm] in this example) but having a pattern of combination of the insertion holes 156 and the face portions 157 in the contact detected part 158, different from that of the tape cartridge 100 shown in FIG. 12A.

The tape cartridge 100 shown in FIG. 12B has the insertion holes 156 formed in the second right wall 107 at positions designated by reference letters a, b, and d and has the face portions 157 formed thereon at positions designated by reference letters c and e. That is, the tape cartridge 100 shown in FIG. 12B has the insertion hole 156 at the position designated by reference letter b which designates the position of the face portion 157 in the tape cartridge 100 shown in FIG. 12A. Similar to the two insertion holes 156 formed at the positions designated by the reference letters a and d, the position in the front-to-rear direction of the insertion hole 156 formed at the position designated by reference letter b differs from the position in the front-to-rear direction of the through-hole 150 (lies rearward of the through-hole 150). The insertion hole 156 formed at the position designated by reference letter a and the insertion hole 156 formed at the position designated by reference letter b are arranged in an array state (side by side) in which those positions in the front-to-rear direction differ from each other and those positions in the top-to-bottom direction are substantially the same as each other. The insertion hole 156 formed at the position designated by reference letter b and the insertion hole 156 formed at the position designated by reference letter d are arranged in an array state (the so-called staggered array) in which those positions in the front-to-rear direction differ from each other and those positions in the top-to-bottom direction differ from each other.

<Structure of Normal Label Type Tape Cartridge>

Although not shown, the normal label type tape cartridge has basically the same structure as that of the above-described die-cut label type tape cartridge 100. In the normal label type tape cartridge 100, however, the print-receiving tape 10 is a normal label type (not having the cut 14 and black mark 13), the right wall 103 of the first arm portion 160A of the housing 101 not including the optically detected part 152, the corner portion 141 of the housing 101 not including the protruding portion 110. In the normal label type tape cartridge 100, the contact detected part 112 defines information of a tape color of the print-receiving tape 10 of the tape cartridge 100 and information of an ink color of the ink ribbon 118 by the combination of the insertion holes 171 and the face portions 172, with the insertion holes 171 being formed on the undersurface 145*a* in number and arrangement corresponding to the shape of the label portion 16.

<Cartridge Holder and Its Periphery>

Referring back to FIGS. 2 to 6, the cartridge holder 4 has, at its left rear corner portion, i.e. at a position on the left side of the pin 26, a sensor 21 (corresponding to a third sensor) having a vertically extending sensor protrusion 23 to be depressed. In the case that the die-cut label type tape cartridge 100 is attached to the cartridge holder 4, the protruding portion 110 of the die-cut label type tape cartridge 100 faces the sensor protrusion 23 so that the sensor protrusion 23 is depressed by the protruding portion 110 to be turned on. On the other hand, in the case that the normal label type tape cartridge 100 is attached to the cartridge holder 4, the sensor protrusion 23 is not depressed remaining off because the normal label type tape cartridge 100 does not have a portion like the protruding portion 110 depressing the sensor protrusion 23. On the basis of on-off information of whether the sensor protrusion 23 is depressed (in other words, whether the protruding portion 110 is present), the sensor 21 detects whether the tape cartridge 100 attached to the cartridge holder 4 is of the die-cut label type or the normal label type, to output a corresponding detection signal to a control circuit not shown. Based on this detection signal, the control circuit can identify whether the tape cartridge 100 attached to the cartridge holder 4 is of the die-cut label type or the normal label type.

The cartridge holder 4 has, on its left part at a substantially central position in the front-to-rear direction, a sensor 55 having a plurality of (five in this example) sensor protrusions 63 to be depressed. In the case that the tape cartridge 100 is attached to the cartridge holder 4, the contact detected part 112 of the tape cartridge 100 confronts the sensor protrusions 63 so that the sensor protrusion 63 corresponding to information related to the tape cartridge 100 is selectively depressed by the contact detected part 112 to be turned on. On the basis of an on-off combination of whether the plurality of sensor protrusions 63 are each depressed at this time (results of contact of the sensor protrusions with the contact detected part 12), the sensor 55 detects information related to the tape cartridge 100, to output a corresponding detection signal to the control circuit. The control circuit can acquire information related to the tape cartridge 100, based on this detection signal. At this time, if the tape cartridge 100 attached to the cartridge holder 4, identified based on the detection signal of the sensor 21 is of the die-cut label type, the control circuit can treat the information related to the tape cartridge 100 acquired based on the detection signal of the sensor 55, as information of the shape of the label portion 16. On the other hand, if the tape cartridge 100 attached to the cartridge holder 4, identified based on the detection signal of the sensor 21 is of the normal label type, the control circuit can treat the information related to the tape cartridge 100 acquired based on the detection signal of the sensor 55, as information of the tape color and the ink color.

The cartridge holder 4 has, on its rear portion at a substantially central position in the left-to-right direction, a sensor 29 for optically detecting the end mark 19 on the print-receiving tape 10 of the tape cartridge 100 attached to the cartridge holder 4.

<Holder Arm, Roller Holder, Release Motor, and Release Rod>

The cartridge holder 4 has, at a position on the right side of the head holder 20, a pivotal support portion 38 made of a U-shaped member extending in the front-to-rear direction. The pivotal support portion 38 pivotally clamps holder arms 36A, 36B extending in the front-to-rear direction around an axis 1 of a support shaft 40 extending in the top-to-bottom direction. The first holder arm 36A is disposed on the lower side in an inner space of the pivotal support portion 38. The second holder arm 36B is disposed on the upper side, i.e. above the first holder arm 36A, in the inner space of the pivotal support portion 38. The second holder arm 36B has an inclined portion 361 whose distance in the top-to-bottom direction from the first holder arm 36A increases from the rear side (the axis AX1 side) toward the front side (toward the platen roller 32 described later). A roller holder 28 is disposed to the front of the holder arms 36A, 36B.

The roller holder 28 is supported by the holder arms 36A, 36B so as to be pivotable around the axis AX1 together with the holder arms 36A, 36B. The roller holder 28 includes the platen roller 32 and the pressure roller 34 that are rotatably disposed. The platen roller 32 exposes its roller surface to the left and is positioned in the roller holder 28 so as to face the thermal head 22. The pressure roller 34 exposes its roller surface to the left and is positioned in the roller holder 28 so as to face the feed roller drive shaft 24 (feed roller 102).

A torsion spring (not shown) is fitted to the support shaft 40 at its lower end positioned in the vicinity of the first holder arm 36A. This torsion spring resiliently urges the holder arms 36A, 36B and the roller holder 28 to the right (opposite to the thermal head 22) around the axis AX1.

Thus, when not pressed leftward (toward the thermal head 22), the holder arms 36A, 36B and the roller holder 28 are retained at a release position (position indicated in FIG. 5) where the platen roller 32 and the pressure roller 34 are apart from the thermal head 22 and the feed roller 102, respectively, by the urging force of the torsion spring. When pressed rightward, the holder arms 36A, 36B and the roller holder 28 pivot rightward from the release position against the urging force of the torsion spring, moving to a print position (position indicated in FIGS. 3 and 4) where the platen roller 32 and the pressure roller 34 can press the print-receiving tape 10 on the feeding path against the thermal head 22 and the feed roller 102, respectively. When the holder arms 36A, 36B and the roller holder 28 move to the print position with the tape cartridge 100 being attached in the cartridge holder 4, rotations of the platen roller 32, the pressure roller 34, and the feed roller drive shaft 24 (feed roller 102) allow the print-receiving tape 10 supplied from the tape cartridge 100 to be transported along a predetermined feeding path.

The body part 2 includes a release motor 71, and a release rod 70 extending in the front-to-rear direction disposed on the right side of the holder arms 36A, 36B. A drive output gear 71*a* of the release motor 71 is operatively coupled via a crank gear mechanism 72 to a cam gear 73*a* disposed on a camshaft 73. The camshaft 73 is inserted and disposed in a crankshaft hole 75 extending in the front-to-rear direction of the release rod 70. As a result, the release motor 71 rotates in one direction at a proper timing, whose driving force is transmitted to the cam gar 73*a* so that the camshaft 73 rotates in a corresponding direction, allowing the release rod 70 to move frontward. On the other hand, the release motor 71 rotates in the other direction opposite to the one direction at a proper timing, whose driving force is transmitted to the cam gear 73*a* so that the camshaft 73 rotates in a corresponding direction, allowing the release rod 70 to move rearward away from the front.

The release rod 70 has at its front end a roller-shaped pressing portion 74. The frontward movement of the release rod 70 as a result of rotational drive to the one direction of the release motor 71 causes the pressing portion 74 to move frontward to abut against the roller holder 28. This allows the holder arms 36A, 36B and the roller holder 28 to rotate rightward around the axis AX1 to move to the print position. When the release rod 70 moves rearward by the rotational drive to the other direction of the release motor 71 from the state where the holder arms 36A, 36B and the roller holder 28 lie at the print position, the pressing portion 74 also moves rearward so that the abutment with the roller holder 28 is released. This allows the holder arms 36A, 36B and the roller holder 28 to rotate leftward around the axis AX1 to move to the release position.

The release rod 70 has at its left part a first engaging portion 70 and a second engaging portion 70*b*. The first engaging portion 70*a* extends on the right front side of the second engaging portion 70*b*.

<Sensor Unit>

A mechanical sensor 54 and an optical sensor 56 (see FIG. 13A, etc. described later) are integrally disposed as a sensor unit 50 on the left side of the release rod 70 in the body part 2, the sensor unit 50 being capable of an advance/retreat relative to the tape cartridge 100 attached to the cartridge holder 4.

The sensor unit 50 will hereinafter be described with reference to FIGS. 3 to 5, 13A, 13B, 14, and 15.

In FIGS. 3 to 5, 13A, 13B, 14, and 15, the sensor unit 50 has a substantially quadrangular portion 53 of a substantially quadrangular shape located on the lower side, and a substantially triangular portion 52 of a substantially triangular shape located on the upper side of the substantially quadrangular portion 53 and having an oblique edge 521. The sensor unit 50 is inserted and disposed in a space 37 (see FIG. 2) between the holder arms 36A, 36B, upstream of the thermal head 22 in the feeding direction, such that the oblique edge 521 of the substantially triangular portion 52 extends along the inclined portion 361 of the second holder arm 36B.

The sensor unit 50 has a plate-shaped substrate 60 located on the right side and a box-shaped unit body 51 located on the left side.

A connector 61 for cable connection is disposed on the right surface of the substrate 60 at the lower end of the substantially quadrangular portion 53. The substrate 60 is connected to the control circuit via a cable (not shown) connected by the connector 61.

The mechanical sensor 54 is disposed on the substantially quadrangular portion 53 of the left surface of the substrate 60, the mechanical sensor 54 having a plurality of (five in this example) sensor protrusions 66 to be pressed vertically projecting leftward from the left surface of the unit body 51 via openings 51*a*, 51*b* formed in the unit body 51. When the sensor unit 50 moves to the detection position described later with the tape cartridge 100 being attached to the cartridge holder 4, the contact detected part 158 of the arm portion 160 of the tape cartridge 100 faces the sensor protrusion 66 so that the contact detected part 158 selectively depresses a sensor protrusion 66 corresponding to information of the tape width of the print-receiving tape 10 of the tape cartridge 100 to turn on. On the basis of an on-off combination of whether the five sensor protrusions 66 are each depressed at this time (results of contact of the sensor protrusions 66 with the contact detected part 158), the mechanical sensor 54 detects information of the tape width of the print-receiving tape 10 of the tape cartridge 100, to output a corresponding detection signal to the control circuit. The control circuit can acquire the tape width based on this detection signal. The mechanical sensor 54 may be configured so as to optically indirectly detect motions of the plurality of sensor protrusions 66, to detect information of the tape width of the print-receiving tape 10 of the tape cartridge 100 based on the detection results.

The optical sensor 56 of reflection type capable of optical detection via an opening 51*c* formed in the unit body 51 is disposed on the substantially triangular portion 52 of the left surface of the substrate 60. The optical sensor 56 includes a light-emitting element 56*a* and a light-receiving element 56*b* that are arrayed in the top-to-bottom direction (in this example, the light-emitting element 56*a* is disposed on the upper side while the light-receiving element 56*b* is disposed on the lower side). When the sensor unit 50 moves to the detection position described later with the tape cartridge 100 being attached to the cartridge holder 4, the optically detected part 152 having a through-hole 150 on the arm portion 160 of the tape cartridge 100 faces the optical sensor 56. In this state, the optical sensor 56 throws light by the light-emitting element 56*a* to the optically detected part 152 (the right surface of the print-receiving tape 10 passing through the through-hole 150) and receives the reflected light by the light-receiving element 56*b*, to detect information related to the print-receiving tape 10 of the tape cartridge 100 based on the result of light reception, consequently outputting a corresponding detection signal to the control circuit. In this embodiment, the optical sensor 56 detects a relative position of the label portion 16 on the print-receiving tape 10 of the tape cartridge 100 with respect to the thermal head 22, based on the light reception result. The control circuit can acquire the relative position of the label portion 16 with respect to the thermal head 22, based on this detection signal. The optical sensor 56 to be mounted may be a transmission type optical sensor.

The unit body 51 has the guide protrusion 58 disposed on the substantially quadrangular portion 53 at a position closer to its rear and top. When the sensor unit 50 moves to the detection position described later with the tape cartridge 100 attached to the cartridge holder 4, the insertion hole 154 of the arm portion 160 of the tape cartridge 100 faces the guide protrusion 58, allowing the guide protrusion 58 to be inserted into the insertion hole 154.

The unit body 51 has a cylindrical portion 62 disposed on the substantially quadrangular portion 53 at a position closer to its rear, the cylindrical portion 62 extending rightward from the right surface of the substrate 60 via a through-hole 601 formed in the substrate 60. A reference shaft 68 for the advancing/retreating motion fitted with a coil spring 64 is inserted into an axial hole 621 of the cylindrical portion 62. The reference shaft 68 is fixed at its right end to a wall 69, with its portion leftward of the right end being inserted and disposed in the crankshaft hole 75 of the release rod 70. The coil spring 64 resiliently urges the sensor unit 50 leftward along an axis AX2 of the reference shaft 68.

At this time, the position of the mechanical sensor 54 in the top-to-bottom direction lies below the position of the reference shaft 68 in the top-to-bottom direction. The position of the optical sensor 56 in the top-to-bottom direction lies above the position of the reference shaft 68 in the top-to-bottom direction.

The cylindrical portion 62 has at its right opening edge a downward extending guide portion 62*a*. The guide portion 62*a* is engaged with the first engaging portion 70*a* or the second engaging portion 70*b* of the release rod 70. The engagement of the guide portion 62*a* with the first engaging portion 70*a* or the second engaging portion 70*b* restrains the sensor unit 50 from moving leftward (advancing) by the urging of the coil sprint 64. The position in the left-to-right direction of the sensor unit 50 relative to the wall 69 is determined in accordance with the engaging portion of the release rod 70 engaged by the guide portion 62*a*. The sensor unit 50 moves in the left-to-right direction while being guided by the first engaging portion 70*a* and the second engaging portion 70*b* of the release rod 70, together with the movement of the release rod 70 in the front-to-rear direction.

That is, when the release rod 70 moves frontward by the rotational drive of the release motor 71 in the one direction, the sensor unit 50 moves leftward while the guide portion 62*a* is guided from the first engaging portion 70*a* to the second engaging portion 70*b*, resulting in the engagement with the second engaging portion 70*b*. Thus, the sensor unit 50 is retained at the detection position (position indicated in FIGS. 2, 3, 4, and 15) where the sensor protrusion 66 of the mechanical sensor 54 confronts the contact detected part 158 and is inserted into the insertion hole 156 or is pressed by the face portion 157 while the guide protrusion 58 is inserted into the insertion hole 154 with the optical sensor 56 facing the optically detected part 152 (through-hole 150). When the release rod 70 moves rearward by the rotational drive of the release motor 71 in the other direction from the state where the sensor unit 50 lies at the detection position, the sensor unit 50 moves rightward and the guide portion 62*a* is guided from the second engaging portion 70*b* to the first engaging portion 70*a* to engage with the first engaging portion 70*a*. As a result, the sensor unit 50 is retained at the release position (position indicated in FIG. 5) where the sensor protrusion 66 of the mechanical sensor 54 is apart from the contact detected part 158 while the guide protrusion 58 is apart from the insertion hole 154, with the optical sensor 56 being apart from the optically detected part 152 (through-hole 150).

Effect of this Embodiment

As described above, this embodiment uses not only the mechanical sensor 54 mechanically detecting information related to the print-receiving tape 10 (in the above example, information of the tape width of the print-receiving tape 10), but also the optical sensor 56 optically detecting (optically detecting in accordance with the light reception result when light is thrown to an object to be detected) information related to the print-receiving tape 10 (in the above example, information of a relative position of the label portion 16 with respect to the thermal head 22 when the die-cut label type tape cartridge 100 is used).

In this embodiment, the optical sensor 56 is integrated with the mechanical sensor 54 performing a mechanical detection in accordance with the result of contact of the detector with the object to be detected, to make up the sensor unit 50 which can advance toward and retreat from the tape cartridge 100. This enables the optical sensor 56 to perform an optical detection in the state where a high-accuracy positioning is achieved so that the distance from the optical sensor 56 to the tape cartridge 100 becomes an optimal distance, as a result of execution of the mechanical detection (detection of contact with the tape cartridge 100 that is an object to be detected) by the mechanical sensor 54. Thus, the optical detection of information of the tape cartridge 100 by the optical sensor 56 can reliably be performed at a high accuracy.

In this embodiment, particularly, the mechanical sensor 54 of the sensor unit 50 advancing by the urging force of the coil spring 64 comes into contact with the tape cartridge 100 to perform the detection. At this time, the guide portion 62*a* limiting the advance of the sensor unit 50 is disposed to a position below the reference shaft 68 in the sensor unit 50, while the optical sensor 56 is disposed to a position above the reference shaft 68 in the sensor unit 50. As a result, as shown in FIG. 16 for example, even in the case that the sensor unit 50 tries to tilt (see white arrows) by a reaction force (see a black arrow) acting on the guide portion 62*a* in the direction away from the tape cartridge 10 at the time of the contact, the optical sensor 56 disposed opposite to the guide portion 62*a* with respect to the reference shaft 68 comes closer to the tape cartridge 100 by the tilt as indicated by in an imaginary line in the diagram. This can reliably prevent the distance from the optical sensor 56 to the tape cartridge 100 from increasing, so that a high detection accuracy can reliably be secured.

In this embodiment, particularly, the mechanical sensor 54 is disposed to a position below the reference shaft 68 in the sensor unit 50, while the optical sensor 56 is disposed to a position above the reference shaft 68 in the sensor unit 50. As a result, as shown in FIG. 17 for example, even in the case that the sensor unit 50 tries to tilt (see white arrows) by a reaction force (see a black arrow) acting on the mechanical sensor 54 in the direction away from the tape cartridge 10 at the time of the contact, the optical sensor 56 disposed opposite to the guide portion 62*a* with respect to the reference shaft 68 comes closer to the tape cartridge 100 by the tilt as indicated by in an imaginary line in the diagram. This can reliably prevent the distance from the optical sensor 56 to the tape cartridge 100 from increasing, so that a high detection accuracy can reliably be secured.

In this embodiment, particularly, the light-emitting element 56*a* and the light-receiving element 56*b* of the optical sensor 56 are arrayed in the top-to-bottom direction. This can enhance the advantage over curling of the print-receiving tape 10.

In this embodiment, particularly, the sensor unit 50 has the connector 61 for cable connection at the lower end of the substantially quadrangular portion 53. This enables the connector 61 to be disposed to a position farther from the light-emitting element 56*a* and light-receiving element 56*b* arranged on the substantially triangular portion 52 of the sensor unit 50, so that the durability of the connector 61 can be prevented from decreasing.

In this embodiment, particularly, the sensor unit 50 is disposed upstream of the thermal head 22 in the feeding direction along the feeding path, while the optical sensor 56 is disposed to the downstream end in the feeding direction along the feeding path in the sensor unit 50. This enables the optical sensor 56 to be disposed to a position closer to the thermal head 22, so that the print start position can be controlled at a high accuracy.

In this embodiment, particularly, the sensor 21 detecting a depression effected by the protruding portion 110 of the die-cut label type tape cartridge 100 is disposed outside the sensor unit 50. As a result, if there is a need to detect a further variety of information on the type of the tape cartridge 100 or on the print-receiving tape 10, information on the relative position of the label portion 16 with respect to the thermal head 22 or information other than the tape width information can further be acquired based on whether the protruding portion 110 is depressed by the sensor 21 when the die-cut label type tape cartridge 100 is used.

In this embodiment, the through-hole 150 is disposed in the right wall 103 of the first arm portion 160A at a portion facing the movement path of the black mark 13, the insertion hole 154 is disposed in the first right wall 105 of the second arm portion 160B, and the insertion hole 156 is disposed in the second right wall 107 of the second arm portion 160B. The position of the insertion hole 154 in the front-to-rear direction lies upstream, in the movement direction of the black mark 13, of the position of the through-hole 150 in the front-to-rear direction and of the position of the insertion hole 156 in the front-to-rear direction. As a result, the mechanical sensor 54 is applied to the insertion hole 156, while the detection by the optical sensor 56 is effected for the through-hole 150. At this time, since the through-hole 150 and the insertion hole 156 are disposed in the side walls of the arm portion 160 in the vicinity thereof, the mechanical sensor 54 and the optical sensor 56 can be configured as the integrated sensor unit 50. In consequence, similar to the above, the optical detection accuracy can be improved. Since the user can check the status (wrinkles, etc.) of the print-receiving tape 10 within the interior of the tape cartridge 100 from the through-hole 150, defective assemblies arising from e.g. pinching of the print-receiving tape 10 at the arm portion 160 during assembling of the tape cartridge 100 can be prevented from flowing out by performing the checking after assembling the tape cartridge 100.

In this embodiment, particularly, the size of the black mark 13 is larger than the size of the through-hole 150. This enables the black mark 13 to block the entire through-hole 150 when the black mark 13 passes over the through-hole 150. As a result, the amount of light deviation can be increased so that the optical detection accuracy can be improved.

In this embodiment, especially, the protruding portion 110 extending along in the top-to-bottom direction is disposed on the corner portion 141 of the housing 101. Consequently, the amount of information can further be increased by detecting whether the protruding portion 110 is present by the sensor 21. By the presence of the protruding portion 110, the user can recognize the tape cartridge 100 as the die-cut label type. Due to the presence of the protruding portion 110, erroneous mounting onto a model not supporting the die-cut label type tape cartridge 100 can be prevented.

In this embodiment, especially, the tape cartridge 100 is disposed in which the vertical position of the lower end 110*a* of the protruding portion 110 is substantially the same as the vertical position of the lower end 120*a* of the roll storing part 120. Disposition of such a tape cartridge 100 enables the displacement of the sensor 21 for detecting the protruding portion 110 to be reduced, while avoiding the imbalance at the time of mounting as in the case where the protruding portion 110 protrudes from the roll storing part 120.

MODIFICATION EXAMPLES, ETC.

The present disclosure is not limited to the above embodiment and can variously be modified without departing from the spirit and technical idea thereof.

Although in the above embodiment, description has been given of an example where the print-receiving tape 10 is wound into the print-receiving tape roll 122, which is attached within the tape cartridge 100 to draw out the print-receiving tape 10, this is not limitative. For example, elongated flat-paper-like or strip tapes or sheets (including ones formed by cutting the tape wound into a roll and drawn out from the roll to an appropriate length) may be stacked in a predetermined storing part (e.g. flatly laminated in a tray-like one) into a cartridge, which in turn is attached to a cartridge holder of the printer so that the tapes or sheets are transferred or transported from the storing part for printing.

If in the above description, there are terms such as "perpendicular", "parallel", and "planar", those terms do not represent their respective strict senses. That is, those "perpendicular", "parallel", "planar", etc. allow designing and manufacturing tolerances and errors and mean "substantially perpendicular", "substantially parallel", "substantially planar", etc.

If in the above description, there are terms such as "the same", "equal", and "different" in external dimensions or size, those terms do not represent their respective strict senses. That is, those "the same", "equal", "planar", etc. allow designing and manufacturing tolerances and errors and mean "substantially the same", "substantially equal", "substantially different", etc. However, if there are values serving as predetermined criteria or separators such as threshold values and reference values, "the same", "equal", "different", etc. used for those values represent their respective strict senses, dissimilar to the above.

Besides the already-described ones, the techniques of the above embodiment and of the modification examples may properly be combined for use.

What is claimed is:

1. A tape cartridge comprising:

a housing having a first side wall on one side in a transverse direction, a second side wall on said one side in said transverse direction and on one side of said first side wall in an orthogonal direction orthogonal to a longitudinal direction and said transverse direction, and a third side wall on said one side in said transverse direction and on said one side of said second side wall in said orthogonal direction;

a tape roll that wound a tape and is stored within said housing, said tape including a strip-shaped first sheet and a strip-shaped second sheet, wherein said first sheet has a first surface and a second surface opposite to each other, said second surface having a mark thereon, the mark extending across only a portion of a width of the first sheet in a vicinity of an edge of the first sheet, and wherein said second sheet is affixed to said first surface of said first sheet and has a cut that divides said second sheet into a label portion and a non-label portion;

a first hole disposed in said first side wall at a portion facing a movement path of said mark of said second surface of said first sheet;

a second hole disposed in said second side wall; and at least one third hole disposed in said third side wall, a position of said second hole in said longitudinal direction of said housing is upstream, in a movement direction of said mark, of a position of said first hole in said longitudinal direction and of a position of said third hole in said longitudinal direction.

2. The tape cartridge according to claim 1, wherein said third hole includes two holes that are different from each other in position in said longitudinal direction but substantially the same as each other in position in said orthogonal direction.

3. The tape cartridge according to claim 1, wherein said third hole includes two holes that are different from each other in position in said longitudinal direction and different from each other in position in said orthogonal direction.

4. The tape cartridge according to claim 1, wherein said third hole includes at least one hole whose position in said longitudinal direction is substantially the same as the position of said first hole in said longitudinal direction.

5. The tape cartridge according to claim 1, wherein the position of said third hole in said longitudinal direction differs from the position of said first hole in said longitudinal direction.

6. The tape cartridge according to claim 1, wherein said housing has at its corner portion a protruding portion extending along said orthogonal direction.

7. The tape cartridge according to claim 6, wherein said housing has two insertion holes disposed in the vicinity of two corner portions each lying on a diagonal, of four corner portions, and said protruding portion is disposed such that a position of said protruding portion in said longitudinal direction is substantially the same as a position of one of said insertion holes in said longitudinal direction.

8. The tape cartridge according to claim 6, wherein said housing comprises:

a roll storing part that extends at least partly along a contour of said tape roll;

a flange part that has a substantially flat-plate-shaped contour, and is disposed on an outer peripheral side of said roll storing part along said longitudinal direction and said transverse direction; and a fourth hole disposed in a surface on said one side of said flange part in said orthogonal direction, and a position of an end on said one side of said protruding portion in said orthogonal direction lies on said one side, in said orthogonal direction, of said surface on said one side having said fourth hole.

9. The tape cartridge according to claim 8, wherein said fourth hole includes at least one hole whose position in said transverse direction is substantially the same as a position of said protruding portion in said transverse direction.

10. The tape cartridge according to claim 8, wherein said housing has, at a position adjacent to said protruding portion in said longitudinal direction, a recessed portion whose position in said orthogonal direction is substantially the same as a position of an end in said orthogonal direction, wherein said end is on said one side of said surface in said orthogonal direction, and wherein said surface is on said one side of said flange part.

11. The tape cartridge according to claim 8, wherein a position of an end on said one side of said protruding portion in said orthogonal direction is substantially the same as a position of an end on said one side of said roll storing part in said orthogonal direction.

12. The tape cartridge according to claim 1, wherein a size of said mark is larger than a size of said first hole.

13. The tape cartridge according to claim 1, wherein said housing includes a first case part on another side in said orthogonal direction and a second case part on said one side in said orthogonal direction, said first case part and said second case part being fixed together and integrated, said first hole is disposed in said first case part, and said second hole and said third hole are disposed in said second case part.

14. A tape cartridge comprising:

a housing having a first side wall, a second side wall on one side of said first side wall, and a third side wall on said one side of said second side wall;

a tape roll that wound a print-receiving tape and is stored within said housing, said print-receiving tape including a strip-shaped first sheet and a strip-shaped second sheet, wherein said first sheet has a first surface and a second surface opposite to each other, and wherein said second sheet is affixed to said first surface of said first sheet and has a cut that divides said second sheet into a label portion and a non-label portion, said second surface of said first sheet having thereon a mark corresponding to said label portion, the mark extending across only a portion of a width of the first sheet in a vicinity of an edge of the first sheet;

a first hole that is configured to be used to detect said mark by an optical sensor, and is disposed in said first side wall at a portion facing a movement path of said mark formed on said second surface of said first sheet; and at least one second hole that is configured to receive a contact-type switch, and is disposed in said third side wall.

15. The tape cartridge according to claim 14, wherein said second side wall of said housing has a third hole configured to guide advance and retreat of a sensor unit including said optical sensor and said contact-type switch that are integrally arranged.

16. The tape cartridge according to claim 14, wherein said second hole is formed in said third side wall in number and arrangement corresponding to a tape width of said print-receiving tape.

17. The tape cartridge according to claim 14, wherein said housing has at its corner portion a protruding portion representing that said print-receiving tape has said first sheet and said second sheet.

18. The tape cartridge according to claim 1, wherein said first sheet of said tape roll comprises:

an end mark disposed in the vicinity of a terminal end on said second surface in a longitudinal direction of the sheet, and a plurality of marks disposed in an area other than the vicinity of the terminal end on said second surface.

19. A printer with cartridge comprising:

a cartridge holder where a cartridge is attached, the cartridge comprising: a housing having a first side wall, a second side wall on one side of said first side wall, and a third side wall on said one side of said second side wall; a tape roll that wound a print-receiving tape and is stored within said housing, said print-receiving tape including a strip-shaped first sheet and a strip-shaped second sheet, wherein said first sheet has a first surface and a second surface opposite to each other, and wherein said second sheet is affixed to said first surface of said first sheet and has a cut that divides said second sheet into a label portion and a non-label portion, said second surface of said first sheet having thereon a mark corresponding to said label portion, the mark extending across only a portion of a width of the first sheet in a vicinity of an edge of the first sheet; an optically detected part having a first hole that is configured to be used to optically detect said mark, and is disposed in said first side wall at a portion facing a movement path of said mark formed on said second surface of said first sheet; and a contact detected part having at least one second hole that is configured to receive a contact-type switch, and is disposed in said third side wall;

a feeder configured to feed said print-receiving tape supplied from said cartridge along a feeding path;

a printing head configured to form print on said print-receiving tape fed by said feeder;

a first sensor that has at least one said contact-type switch, and is configured to detect first information related to said print-receiving tape of said cartridge, based on a result of contact of said contact-type switch with said contact detected part; and a second sensor configured to project light to said optically detected part and thereby detect second information related to said print-receiving tape of said cartridge, based on a result of light reception corresponding to the projected light, said first sensor and said second sensor being integrated as a sensor unit configured to perform advancing motion to and retreating motion from said cartridge.

20. A tape cartridge comprising:

a housing having a first side wall on one side in a transverse direction, a second side wall on said one side in said transverse direction and on one side of said first side wall in an orthogonal direction orthogonal to a longitudinal direction and said transverse direction, and a third side wall on said one side in said transverse direction and on said one side of said second side wall in said orthogonal direction;

a tape roll that wound a tape and is stored within said housing, said tape including a strip-shaped first sheet and a strip-shaped second sheet, wherein said first sheet has a first surface and a second surface opposite to each other, said second surface having a mark thereon, the mark extending across only a portion of a width of the first sheet in a vicinity of an edge of the first sheet, and wherein said second sheet is affixed to said first surface of said first sheet and has a cut that divides the second sheet into a label portion and a non-label portion;

an optically detected part disposed in said first side wall at a portion facing a movement path of said mark of said second surface of said first sheet;

a second hole disposed in said second side wall; and at least one third hole disposed in said third side wall;

a position of said second hole in said longitudinal direction of said housing is upstream, in a movement direction of said mark, of a position of said optically detected part in said longitudinal direction and of a position of said third hole in said longitudinal direction.

* * * * *